US007083526B2

(12) United States Patent
Durnin

(10) Patent No.: US 7,083,526 B2
(45) Date of Patent: Aug. 1, 2006

(54) GOLF PUTTER

(76) Inventor: Timothy Durnin, 921 Sunnybrae Blvd., San Mateo, CA (US) 94402

( * ) Notice: Subject to any disclaimer, the term of this patent is extended or adjusted under 35 U.S.C. 154(b) by 59 days.

(21) Appl. No.: 10/767,323

(22) Filed: Jan. 28, 2004

(65) Prior Publication Data

US 2005/0164805 A1 Jul. 28, 2005

(51) Int. Cl.
*A63B 53/04* (2006.01)
*A63B 69/36* (2006.01)

(52) U.S. Cl. ..... 473/251; 473/252; 473/334; 473/340; 473/341; 473/249; 473/337; 473/338

(58) Field of Classification Search ..... 473/324–350, 473/251–255, 249
See application file for complete search history.

(56) References Cited

U.S. PATENT DOCUMENTS

| | | | | |
|---|---|---|---|---|
| 1,497,578 | A * | 6/1924 | Mothersele | 473/344 |
| D138,438 | S * | 8/1944 | Link | D21/752 |
| D138,441 | S * | 8/1944 | Link | D21/752 |
| 3,143,349 | A * | 8/1964 | Macintyre | 473/338 |
| 3,841,640 | A | 10/1974 | Gaulocher | |
| 3,873,094 | A | 3/1975 | Sebo et al. | |
| D246,329 | S | 11/1977 | Little | |
| 4,390,184 | A * | 6/1983 | Rudell | 473/253 |
| 4,423,874 | A * | 1/1984 | Stuff, Jr. | 473/338 |
| 4,775,156 | A | 10/1988 | Thompson | |
| 5,078,398 | A | 1/1992 | Reed et al. | |
| 5,167,414 | A | 12/1992 | Montgomery, III | |
| 5,275,412 | A * | 1/1994 | Innes | 473/253 |
| 5,431,401 | A * | 7/1995 | Smith | 473/251 |
| 5,433,444 | A | 7/1995 | Chiuminatta et al. | |
| 5,439,222 | A | 8/1995 | Kranenberg | |
| 5,485,997 | A | 1/1996 | Schmidt et al. | |
| 5,489,097 | A | 2/1996 | Simmons | |
| 5,509,660 | A | 4/1996 | Elmer | |
| 5,518,243 | A | 5/1996 | Redman | |
| 5,676,606 | A | 10/1997 | Schaeffer et al. | |
| 5,685,784 | A | 11/1997 | Butler | |
| 5,746,664 | A | 5/1998 | Reynolds, Jr. | |
| D395,692 | S | 6/1998 | Butler | |
| 5,769,737 | A | 6/1998 | Holladay et al. | |
| 5,842,935 | A | 12/1998 | Nelson | |
| 5,871,407 | A * | 2/1999 | Tseng | 473/328 |
| 5,938,540 | A | 8/1999 | Lu | |
| 6,012,989 | A | 1/2000 | Saksun, Sr. | |
| 6,102,814 | A | 8/2000 | Grace et al. | |
| 6,176,791 | B1 | 1/2001 | Wright | |

(Continued)

FOREIGN PATENT DOCUMENTS

JP 2001-137400 * 5/2001

(Continued)

*Primary Examiner*—Sebastiano Passaniti
(74) *Attorney, Agent, or Firm*—James P. Broder

(57) ABSTRACT

A golf putter (10) includes a putter head (316) having a putter body (320), a heel weight (344H), a toe weight (344T) and a first sole insert (354F). The putter body (320) includes a heel region (330) and a toe region (332), and is formed from a material having a first specific gravity. The heel weight (344H), the toe weight (344T) and the first sole insert (354F) are each formed from materials having specific gravities that are greater than the first specific gravity. In one embodiment, the putter head (316) also includes a second sole insert (354S). The sole inserts (354F, 354S) are positioned partly in the heel region (330) and partly in the toe region (332) of the putter body (320). In another embodiment, the first sole insert (354F) has a first specific gravity, and the second sole insert (354S) has a second specific gravity that is greater than the first specific gravity.

60 Claims, 8 Drawing Sheets

U.S. PATENT DOCUMENTS

| | | | | |
|---|---|---|---|---|
| 6,273,831 | B1 | 8/2001 | Dewanjee | |
| 6,336,869 | B1 | 1/2002 | Hettinger et al. | |
| 6,348,014 | B1 | 2/2002 | Chiu | |
| 6,375,583 | B1 | 4/2002 | Solheim | |
| 6,379,259 | B1 | 4/2002 | Opie | |
| D457,586 | S | 5/2002 | Tang et al. | |
| D458,656 | S | 6/2002 | Tang et al. | |
| 6,422,950 | B1 | 7/2002 | Whitlam | |
| 6,428,423 | B1 | 8/2002 | Merko | |
| 6,440,006 | B1 * | 8/2002 | Johnson | 473/252 |
| 6,450,894 | B1 | 9/2002 | Sun et al. | |
| 6,471,600 | B1 | 10/2002 | Tang et al. | |
| 6,478,690 | B1 | 11/2002 | Helmstetter et al. | |
| 6,488,595 | B1 | 12/2002 | Grace | |
| 6,506,125 | B1 | 1/2003 | Helmstetter et al. | |
| 6,663,505 | B1 * | 12/2003 | Solari | 473/334 |
| 6,896,625 | B1 * | 5/2005 | Grace | 473/251 |
| 6,902,496 | B1 * | 6/2005 | Solheim et al. | 473/341 |

FOREIGN PATENT DOCUMENTS

| | | | |
|---|---|---|---|
| JP | 2001-224717 | * | 8/2001 |

* cited by examiner

GOLF PUTTER

FIELD OF THE INVENTION

The present invention pertains to golf putters, and more specifically, to putter heads for golf putters.

BACKGROUND

The most commonly used club in a typical golf bag is the putter. Approximately one-third to one half of a golfer's strokes on the golf course are taken using a putter. The design of golf putters varies widely. Putter heads can be manufactured having different weighting characteristics, sizes, shapes and colors. Putter heads have progressed from a simple blade-shaped design to more sophisticated designs such as mallet-type putter heads which can include particular weight distributions to improve performance.

It is well known that weight distribution in a putter head can affect the moment of inertia of the putter head. As used herein, the moment of inertia is defined as the tendency of the putter head to rotate about its center of gravity when impacting a golf ball at locations spaced from the center of gravity. If the putter head is more resistant to twisting upon an off-center impact with the ball, there is a higher likelihood that the ball will move toward the intended target. Thus, a higher moment of inertia translates into greater forgiveness for off-center ball-striking, e.g. increased directional control of the ball. Further, decreasing the tendency of the putter head to twist on impact causes a more direct transfer of energy between the movement of the putter head and movement of the ball, resulting in better distance control while putting. In addition, the weight distribution of a putter head can impact the spin of the ball following contact with the face of the putter. Generally, a putter head that provides the ball with a certain amount of topspin while reducing the likelihood of sidespin or skidding along the surface of the green is desired.

Traditionally, putter heads have been formed entirely of metal, such as stainless steel or other alloys. Current putter heads can include face inserts formed from materials that are different than the remainder of the putter head. However, achieving the precise weight and balance, along with a high moment of inertia to provide a more optimal loft and a truer roll of the ball following impact has historically been difficult, if not elusive.

Accordingly, the need exists to provide a putter head having improved weighting and balance characteristics for a more consistent putting stroke and improved loft and roll of the ball after impact. A further need exists to provide a putter head having a high moment of inertia for to maintain a truer roll and decreased twisting of the putter head upon impact with the ball. Another need exists to provide a putter that is easy to use and cost-efficient to manufacture.

SUMMARY

A golf putter in accordance with the present invention includes a putter body, a heel weight, a toe weight and a first sole insert. The putter body has a centrally positioned transition plane that demarcates or divides the putter body into a heel region and a toe region. The putter body includes a sole region that defines a first sole cavity. In one embodiment, the putter body is formed substantially from a material having a first specific gravity. The heel weight is secured to the heel region, and is formed substantially from a material having a second specific gravity that is greater than the first specific gravity. The toe weight is secured to the toe region, and is formed substantially from a material having a third specific gravity that is greater than the first specific gravity. The first sole insert is inserted into the first sole cavity, and is formed substantially from a material having a fourth specific gravity that is greater than the first specific gravity.

In another embodiment, the golf putter includes a putter body, a first sole insert and a second sole insert. The putter body includes a sole region that defines a first sole cavity and a second sole cavity, with each sole cavity being positioned partly in the heel region and partly in the toe region of the putter body. The first sole insert is inserted into the first sole cavity, and the second sole insert is inserted into the second sole cavity.

In yet another embodiment, the golf putter includes a putter body, a first sole insert and a second sole insert. In this embodiment, the first sole insert has a first specific gravity, and the second sole insert has a second specific gravity that is greater than the first specific gravity.

The present invention also includes a method for manufacturing a putter head of a golf putter.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
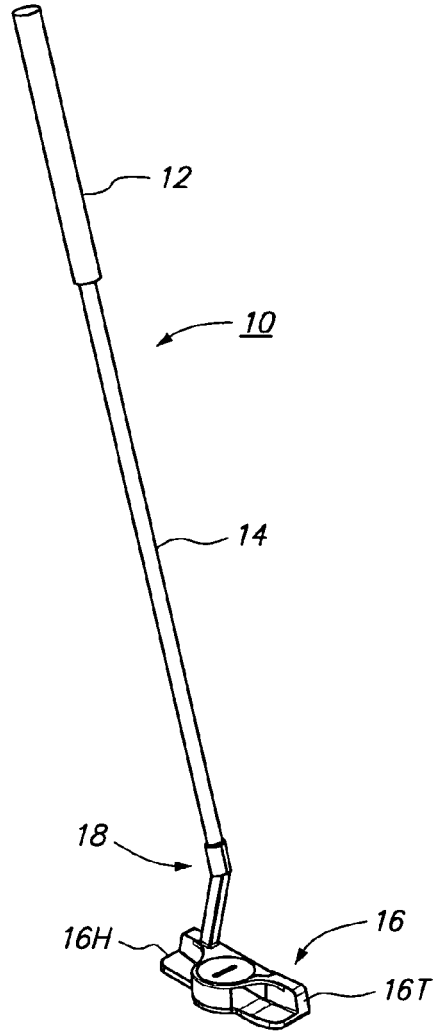
FIG. 1 is a perspective view of a golf putter having features of the present invention.

FIG. 1 is a perspective view of an embodiment of a golf putter 10 having features of the present invention, including a grip 12, a shaft 14 and a putter head 16 that can include an attached hosel 18. The grip 12 is positioned on the shaft 14. The grip 12 can be formed from rubber, leather, plastic or other suitable materials that provide a user with a sufficient grip 12 on the golf putter 10.

In the embodiment illustrated in FIG. 1, the shaft 14 is secured to the hosel 18 of the putter head 16. In one or more alternative embodiments, the putter head 16 does not include a hosel 18, and the shaft 14 can be directly or indirectly secured to the putter head 16 by other suitable means. The putter head 16 includes a heel 16H and a toe 16T.

Figure 2A:
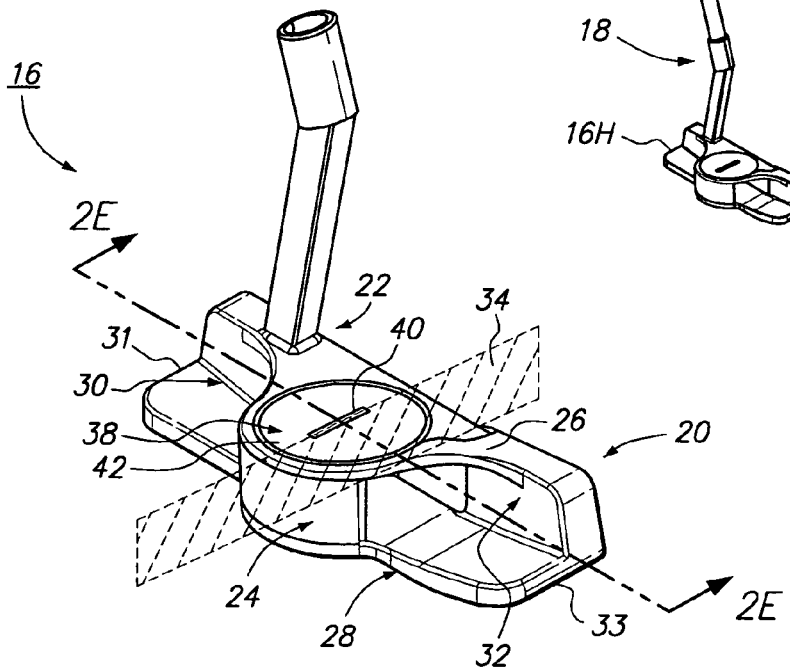
FIG. 2A is a perspective view of a first embodiment of a putter head having features of the present invention.

FIG. 2A is a perspective view of a first embodiment of the putter head 16. The design of the putter head 16 can be varied to suit the design requirements of the putter 10. In this embodiment, the putter head 16 generally includes the hosel 18, a putter body 20 and a plurality of inserts. As used herein, the putter body 20 is defined as a generally unitary structure that forms a portion of the putter head 16, and which receives one or more of the inserts, as described in greater detail below. Moreover, the putter body 20 defines one or more cavities (not shown in FIG. 2A) that each receives one insert. The cavities are also described in greater detail below.

More specifically, the putter head 16 includes a face region 22, a back region 24, an upper region 26 and a sole region 28. The face region 22 is spaced apart from the back region 24. In the embodiment illustrated in FIG. 2A, the upper region 26 is spaced apart from the sole region 28. In an alternative embodiment, the sole region 28 and the upper region 26 are formed as a unitary structure such that there is no gap between the sole region 28 and the upper region 26. Stated another way, the upper region 26 can be one side of a portion of the putter body 20, while the sole region 28 can be another side of the portion of the putter body 20, which generally faces in a direction opposite that of the upper region 26.

Further, the putter head 16 can also be divided into a heel region 30 that includes the heel 16H, and a toe region 32 that includes the toe 16T. Basically, the heel region 30 is defined as at least a portion of the putter head 16 that is more proximal to the feet of one using the putter 10 during a typical putting stroke, while the toe region 32 is defined as at least a portion of the putter head 16 that is more distal to the feet of one using the putter 10 during a typical putting stroke.

Thus, the heel region 30 can include a portion of the face region 22, the back region 24, the upper region 26 and the sole region 28. Further, the toe region 32 can also include a different portion of the face region 22, the back region 24, the upper region 26 and the sole region 28. In this embodiment, a centrally positioned transition plane 34 (shown as a dashed plane) is illustrated in FIG. 2A which approximately demarcates the putter head 16 into the heel region 30 and the toe region 32. As used herein, the transition plane 34 is a theoretical plane that forms a boundary between the heel region 30 and the toe region 32. In other words, the transition plane 34 is where the heel region 30 and the toe region 32 meet.

The putter body 20 can be formed from a variety of materials. For example, the putter body 20 can be formed from metals, metal alloys, plastics, ceramics, composites, wood, or any other suitably strong materials. In one embodiment, the putter body 20 is formed from stainless steel. The putter body 20 can be cast, milled, molded, carved, ground, sanded or otherwise formed and/or shaped in any other suitable manner known in the art.

The face region 22 includes a generally planar face surface 36 (illustrated in FIG. 2D) for striking a golf ball (not shown). The face surface 36 can be flat or slightly curved, for example. In one embodiment, the face surface 36 can form an angle with the upper region 26 within the range of between approximately 90 and 100 degrees. In another embodiment, the face surface 36 can form an angle with the sole region 28 within the range of between approximately 80 and 90 degrees. More specifically, in one embodiment, the face surface 36 can form an angle within the range of approximately 0 to 10 degrees from vertical. In alternative embodiments, the face surface 36 can be within the range of 2.0 to 8.0 degrees, 3.0 to 7.0 degrees, 4.0 to 6.0 degrees, or approximately 5.0 degrees from vertical.

In the embodiment illustrated in FIG. 2A, the back region 24 extends substantially vertically between the upper region 26 and the sole region 28 on a backside of the putter head 16. In this embodiment, the back region 24 is substantially arc-shaped, and can have a radius of curvature that is approximately equal to or somewhat larger than that of a standard golf ball. In an alternative embodiment, the back region 24 can be parabolic or can have another configuration.

In the embodiment illustrated in FIG. 2A, the upper region 26 extends between the face region 22 and the back region 24. In this embodiment, a portion of the upper region 26 can have a somewhat semicircular shape. Further, the upper region 26 can be curved or arc-shaped near the back region 24, and can be relatively linear near the face region 22, as illustrated in FIG. 2A. The upper region 26 can have a substantially uniform thickness, or can have a thickness that varies.

The upper region 26 can also include one or more upper region inserts 38. The size and shape of the upper region insert can vary. For example, the upper region insert 38 illustrated in FIG. 2A is substantially circular-shaped or disc-shaped, and can have a diameter that is similar to or somewhat smaller than the diameter of a standard golf ball. In one embodiment, the diameter of the upper region insert 38 is less than 1.60 inches and greater than approximately 1.00 inches. In an alternative embodiment, the diameter of the upper region insert 38 is less than approximately 1.55 inches and greater than approximately 1.25 inches. In yet another alternative embodiment, the diameter of the upper region insert 38 is less than approximately 1.52 inches and greater than approximately 1.40 inches. In still another alternative embodiment, the diameter of the upper region insert 38 is approximately 1.50 inches. In still alternative embodiments, the upper region insert can be another shape, such as oval, triangular, rectangular, hexagonal, octagonal or another suitable geometry. By using a upper region insert 38 that is somewhat smaller than an actual golf ball, it is believed that a more accurate alignment between the putter head 16 and the golf ball can be achieved at impact.

The upper region insert 38 can be formed from materials having a different specific gravity and/or density than the materials that substantially form the putter body 20. In one embodiment, the upper region insert 38 is formed from materials having a lower specific gravity and/or density than the materials that substantially form the remainder of the putter body 20. For example, the upper region insert 38 can be formed from plastic, aluminum or other alloys, epoxy resin, or other suitable relatively lightweight materials. In these embodiments, the thickness of the upper region insert 38 can vary depending upon the desired weighting, balance, center of gravity and/or moment of inertia of the putter head 16.

Alternatively, the upper region insert 38 can be formed from the same material used to form the putter body 20, such as stainless steel, for example. Additionally, the upper region insert 38 can be at least partly the color of a standard white or other colored golf ball, or can have another suitable color or appearance.

Further, the upper region insert 38 can include an alignment guide 40 that assists the golfer in aligning a putt and/or increases the likelihood of a truer putting stroke. The alignment guide 40 can be an impression or an indentation in a top side 42 of the upper region insert 38. Alternatively, the alignment guide 40 can include a black or other colored marking on the top side 42 of the upper region insert 38. In one embodiment, the alignment guide 40 is substantially linear, and/or can be substantially rectangular in shape. In an alternative embodiment, the alignment guide 40 can be triangular, arrow-shaped, circular, oval, or can have another suitable geometry that assists the golfer in aligning a putt and/or increasing the likelihood of a truer putting stroke.

In the embodiment illustrated in FIG. 2A, the sole region 28 extends between the face region 22 and the back region 24. The configuration of the sole region 28 can vary. In one embodiment, the thickness of the sole region 28 can be substantially uniform from heel 16H to toe 16T. In an alternative embodiment, the thickness of the sole region 28 can vary moving from heel 16H to toe 16T. Additionally, the sole region 28 can have a thickness that is equal to or greater than a thickness of the upper region 26, which can provide the putter head 16 with an overall lower center of gravity.

Figure 2B:
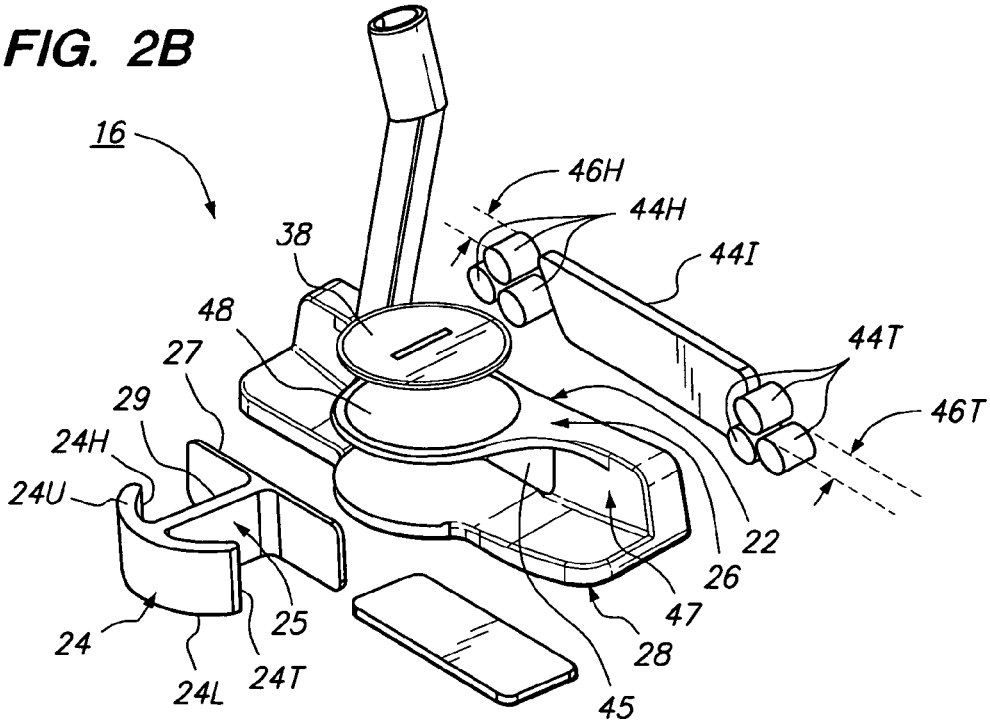
FIG. 2B is an exploded top view of the putter head illustrated in FIG. 2A.

FIG. 2B is an exploded top view of an embodiment of the putter head 16. In the embodiment illustrated in FIG. 2B, the face region 22 includes one or more heel weights 44H, one or more toe weights 44T, an intermediate face insert 44I that can form a portion of the face surface 36 (illustrated in FIG. 2D), and a backside face cavity 45 that is positioned on a backside 47 of the face region 22. In this embodiment, the putter head 16 includes three substantially similar heel weights 44H and three substantially similar toe weights 44T. It should be recognized, however, that greater or fewer than three heel weights 44H and/or toe weights 44T can be used in the putter head 16 provided herein.

The material used to form the heel and toe weights 44H, 44T can affect the balance, center of gravity, and/or moment of inertia of the putter head 16. For example, the heel weights 44H and/or toe weights 44T can be formed substantially from materials having a greater specific gravity than a specific gravity of the material used to substantially form at least a portion of the putter body 20. In one embodiment, the specific gravity of the heel weights 44H and/or toe weights 44T can be at least approximately 50 percent greater than the specific gravity of the putter body 20. In alternative embodiments, the specific gravity of the heel weights 44H and/or toe weights 44T can be at least approximately 100 percent, 150 percent, 200 percent, 250 percent, 300 percent, 350 percent or 400 percent greater than the specific gravity of the putter body 20, as non-exclusive examples. In yet another alternative embodiment, the specific gravity of the heel weights 44H and/or toe weights 44T can be greater or less than the stated percentages relative to the specific gravity of the putter body 20.

For instance, the heel weights 44H and/or toe weights 44T can be formed substantially from tungsten, lead, copper or other suitable materials, as non-exclusive examples. The disparity in specific gravity between the heel weights 44H and/or toe weights 44T on the one hand, and the putter body 20 on the other hand, in conjunction with the positioning of the heel weights 44H and the toe weights 44T, provides stability to the putter head 16 during putting that inhibits a twisting moment which can result in an errant putt.

In one embodiment, the heel weights 44H and the toe weights 44T are substantially identical in shape and size. Alternatively, the heel weights 44H can be a different shape and/or size than the toe weights 44T. In yet another embodiment, each of the heel weights 44H can have a different shape, and/or each of the toe weights 44T can have a different shape.

In the embodiment illustrated in FIG. 2B, the heel weights 44H are arranged in somewhat of a triangular pattern. Each heel weight 44H has a depth 46H that can be substantially similar, or can vary to influence the weighting of the putter head. For example, by varying the depths 46H, and thus the weight of one or more of the heel weights 44H, the weighting of the putter head 16 can be varied, i.e. toward the heel edge 31 or toward the transition plane 34, for instance.

In addition, the toe weights 44T are arranged in somewhat of a triangular pattern. Each toe weight 44T has a depth 46T that can be substantially similar, or can vary to influence the weighting of the putter head 16. For example, by varying the depths 46T, and thus the weight of one or more of the toe weights 44T, the weighting of the putter head 16 can be varied, i.e. toward the toe edge 33 or toward the transition plane 34, for instance. Stated another way, using heel weights 44H and toe weights 44T having different respective depths 46H, 46T, a lower center of gravity can be achieved, thereby providing a truer roll and spin of the golf ball off the face region 22 of the putter head 16. The shape, size and positioning of the heel weights 44H and the toe weights 44T in conjunction with other components of the putter head 16 can also affect the balance, center of gravity, and/or moment of inertia of the putter head 16, each of which can provide a truer roll and topspin of the golf ball, as explained in greater detail below.

The intermediate face insert 44I can be substantially formed from a material having a lower specific gravity than the specific gravity of the material that substantially forms the putter body 20. For example, the intermediate face insert 44I can be formed from aluminum, various plastics, ceramic, or other relatively lightweight materials. With this design, the weight of the putter head 16 is distributed away from the ball-striking surface, and toward the heel 16H, the toe 16T and the back region 24.

Further, in this embodiment, the back region 24 includes a back upper edge 24U, a back lower edge 24L, a back heel edge 24H, a back toe edge 24T and a partition member 25. As illustrated in FIG. 2B, the back region 24 can have an arc length that varies depending on the design requirements of the putter 10. In one embodiment, the arc length is greater than approximately 30 degrees and less than approximately 180 degrees. In an alternative embodiment, the arc length of the back region 24 is greater than approximately 60 degrees and less than approximately 135 degrees. In yet another embodiment, the arc length is greater than approximately 75 degrees and less than approximately 120 degrees. In another embodiment, the arc length is greater than approximately 90 degrees and less than approximately 105 degrees. In still an alternative embodiment, the arc length is approximately 100 degrees. It is recognized by those skilled in the art that varying the arc length can advantageously influence the vibratory characteristics of the putter head 16 on impact with a golf ball, as well as the overall weight, balance, stiffness, flex, center of gravity and/or moment of inertia of the putter head 16.

The partition member 25 can extend vertically between the upper region 26 and the sole region 28. In addition, the partition member 25 can extend from the back region 24 to the backside 47 of the face region 22. In the embodiment illustrated in FIG. 2B, the partition member 25 can be substantially T-shaped, and can include a partition insert 27 and a partition wall 29. The partition insert 27 is generally parallel to the face surface 36, and the partition wall 29 can be substantially perpendicular to the partition insert 27. The partition insert 27 is inserted and fits into the backside face cavity 45 of the backside 47 of the face region 22. The partition insert 27 can be formed from a relatively lightweight material having a specific gravity that is lower than the specific gravity of the material used to form the putter body 20. For example, the partition insert 27 can be formed from various plastics, aluminum, other lightweight metal alloys, or any other suitably lightweight materials. With this design, the weight of the face region 22 is reduced and distributed to other more perimeter regions of the putter head 16.

The partition wall 29 is approximately in alignment with the transition plane 34 (illustrated in FIG. 2A) and the alignment guide 40. The positioning of the partition wall 29 can provide additional stability during putting given the location of the partition wall 29 being in line with the approximate ball-striking location on the face region 22. The partition wall 29 can be formed from a relatively lightweight material having a specific gravity that is lower than the specific gravity of the material used to form the putter body 20. For example, the partition wall 29 can be formed from various plastics, aluminum, other lightweight metal alloys, or any other suitably lightweight materials. With this design, the overall weight of the putter head 16 is reduced and is redistributed to other more perimeter regions of the putter head 16. Alternatively, the partition member 25 does not include a partition insert 27, and the partition wall 29 is secured directly to the backside 47 of the face region 22.

In an alternative embodiment, the partition member 25 can include two or more spaced apart partition walls 29. In one such embodiment, two partition walls 29 are spaced apart the approximate diameter of a standard golf ball, and are positioned on either side of the transition plane 34. However, the spacing between the adjacent partition walls 29 can be greater or less than this distance.

The back region 24 can be formed from the same material used to form the remainder of the putter body 20. For example, both the back region 24 and the remainder of the putter body 20 can be formed from stainless steel. Alternatively, the back region can be formed from a different material having a greater or lower specific gravity than the remainder of the putter body 20. In one embodiment, the back region 24 is formed from a material having a greater specific gravity than the remainder of the putter body 20, such as tungsten, copper, or another suitable material. With this design, the shape and the materials used to form the back region 24 effectively concentrate a portion of the weight of the putter head 16 near a perimeter of the putter head 16, thereby increasing the moment of inertia of the putter head 16.

FIG. 2B also illustrates that the upper region 26 also defines an upper region cavity 48 that receives the upper region insert 38. In this embodiment, the upper region cavity 48 is sized and shaped to accommodate the upper region insert 38. The upper region insert 38 can be fixedly or removably secured to the upper region cavity 48 with an adhesive material or by another suitable method. In one embodiment, the top side of the upper region insert 38 is approximately flush with a top surface of the upper region 26. In another embodiment, the upper region insert 38 can be threadedly secured to the upper region cavity 48, thereby allowing the user to rotate or remove the upper region insert 38 as necessary. In an alternative embodiment, the upper region insert 38 can be formed as a unitary structure with the remainder of the upper region 26, in which case the upper region cavity 48 is omitted.

Figure 2C:
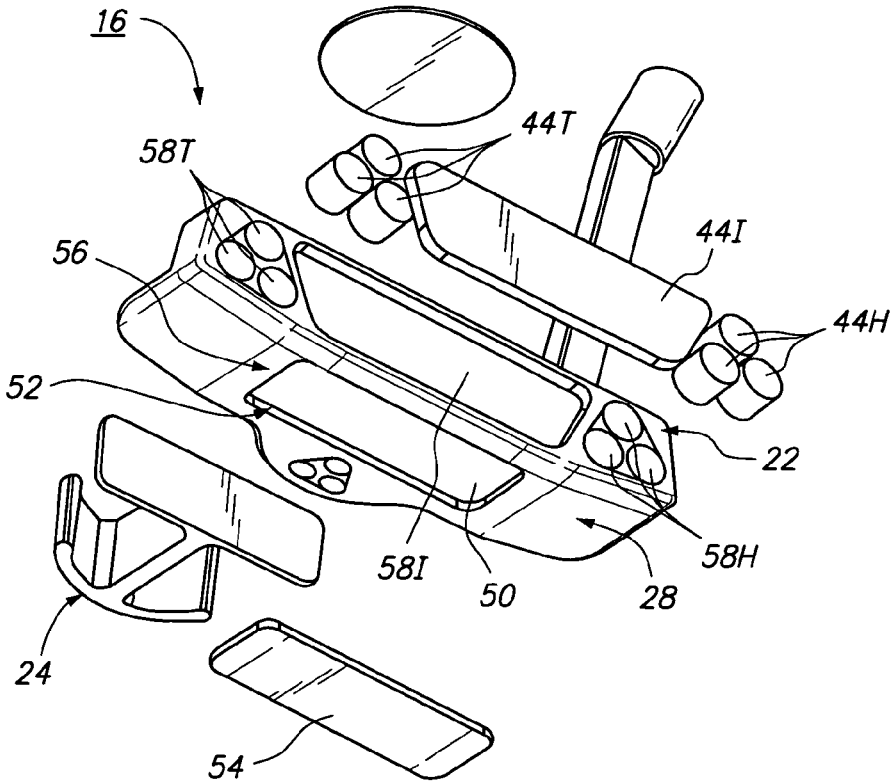
FIG. 2C is an exploded bottom view of the putter head illustrated in FIG. 2A.

FIG. 2C is a bottom exploded view of the putter head 16 illustrated in FIG. 2A. In this embodiment, the putter body 20 includes one or more heel cavities 58H that each receives one of the heel weights 44H. Additionally, the putter body 20 includes one or more toe cavities 58T that each receives one of the toe weights 44T. Further, the putter body 20 includes an intermediate face cavity 58I that receives the intermediate face insert 44I.

The face inserts 44H, 44T, 44I can be adhered to the putter body 20 using any one of a variety of methods. For example, one or more of the face inserts 44H, 44T, 44I can be adhesively secured to the putter body 20. Alternatively, one or more of the face inserts 44H, 44T, 44I can be welded, or can include a top coat (not shown) of plastic or other material that secures the face inserts 44H, 44T, 44I within the respective face cavities 58H, 58T, 58I. Further, the face inserts 44H, 44T, 44I can be removably snapped or otherwise held into place within the face cavities 58H, 58T, 58I. It is recognized that any suitable method can be used to secure the face inserts 44H, 44T, 44I to the putter body 20, and that the foregoing examples are merely provided as non-exclusive, representative methods.

Further, in this embodiment, the putter head 16 can include one or more sole cavities 50 positioned within the sole region 28. It is recognized that the positioning and dimensions of the sole cavity 50 can vary from the embodiments illustrated herein depending upon the design requirements of the golf putter 10 and the putter head 16. The sole cavity 56 illustrated in FIG. 2C has a sole cavity perimeter 52 that is defined entirely within the sole region 28. In other words, in this embodiment, the sole cavity perimeter 52 of the sole cavity 50 does not extend to the face region 22 or the back region 24 of the putter head 16. In an alternative embodiment, the sole cavity perimeter 52 of the sole cavity 50 can extend to the face region 22 and/or the back region 24 of the putter head 16.

In this embodiment, the sole cavity 50 has a generally rectangular footprint. However, any geometry can be used. For example, the footprint of the sole cavity 50 can be oval, circular, triangular, or any other suitable polygonal shape. Additionally, the depth of the sole cavity 50 illustrated in FIG. 2C is substantially uniform. However, the depth of the sole cavity 50 can vary. For instance, the sole cavity 50 can be substantially wedge-shaped, concave, convex, U-shaped, V-shaped, or can have another suitable configuration.

In the embodiment illustrated in FIG. 2C, the putter head 16 includes a sole insert 54 that is inserted into the sole cavity 50. Somewhat similarly to the sole cavity 50, the positioning and dimensions of the sole insert 54 can vary. In this embodiment, the sole insert 54 is substantially flush with a sole surface 56 of the sole region 28. Stated another way, regardless of the shape of the sole surface 56, the sole insert 54 can follow the contour of the sole surface 56 to provide a smooth sole region 28 for moving along a putting surface. In an alternative embodiment, the sole insert 54 can be recessed from the sole surface 56.

Further, the materials used to form the sole insert 54 can vary. For example, in this embodiment, the sole insert 54 can be formed from a relatively lightweight material such as polyurethane, other plastic materials or epoxy compounds. In this embodiment, the sole insert 54 can have a specific gravity that is lower than a specific gravity of the putter body 20. Thus, the weighting of the putter head 16 is altered so that more of the weight of the putter head is distributed toward the heel region 30, the toe region 32 and the back region 24 of the putter head 16. With this design, the moment of inertia upon striking a golf ball is increased, resulting in a decreased likelihood of the putter head 16 twisting on impact.

In alternative embodiments, the specific gravity of the material that forms the sole insert 54 is less than approximately 90%, 75%, 50%, 40%, 30%, 25%, 20%, 15% or 10% of the specific gravity of the putter body 20. For example, in one embodiment, the specific gravity of a stainless steel putter body 20 can be approximately 7,500–8,000 kg/m$^3$, and the specific gravity of the sole insert 54 can be approximately 1,200–1,500 kg/m$^3$ (approximately 15–20% of the specific gravity of the putter body 20) depending upon the precise materials used to form the polyurethane sole insert 54. It is recognized that the foregoing example is provided for representative purposes only, and is not intended to limit the types of materials that can be used with the present invention.

Still alternatively, the sole insert 54 can be formed from a relatively heavy material, such as various metal alloys, ceramics, or other suitable materials. In this embodiment, the sole insert 54 can have a specific gravity that is greater than the specific gravity of the putter body 20.

The sole insert 54 can be adhered to the putter body 20 using any one of a variety of methods. For example, the sole insert 54 can be adhesively secured to the sole cavity 50 of the putter body 20. Alternatively, the sole insert 54 can be welded, or can include a top coat (not shown) of plastic or other material that secures the sole insert 54 within the sole cavity 50. Further, the sole insert 54 can be removably snapped or otherwise held into place within the sole cavity 50. It is recognized that any suitable method can be used to secure the sole insert 54 to the putter body 20, and that the foregoing examples are merely provided as non-exclusive, representative methods.

Figure 2D:
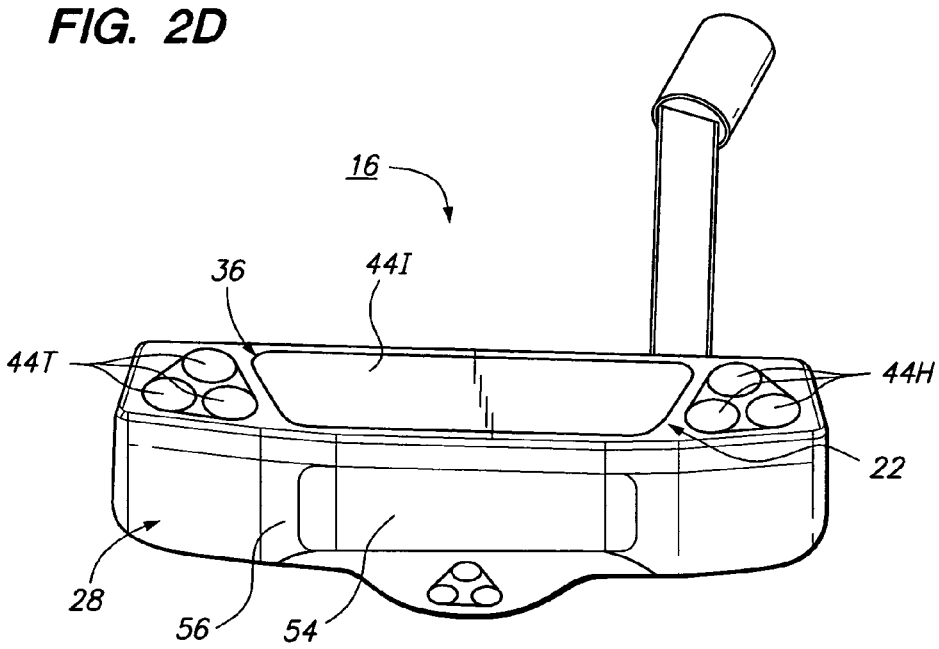
FIG. 2D is a bottom perspective view of the putter head illustrated in FIG. 2A.

FIG. 2D is a bottom perspective view of the putter head 16 illustrated in FIG. 2A. In this embodiment, the heel weights 44H, toe weights 44T, and intermediate face insert 44I are each positioned to be substantially flush with the face surface 36 of the face region 22. In an alternative embodiment, the heel weights 44H, toe weights 44T, and intermediate face insert 44I can be positioned to be recessed somewhat from the face surface 36 of the face region 22.

In still an alternative embodiment, the heel weights 44H and/or the toe weights 44T can be positioned in other locations. For example, in one embodiment, the heel weights 44H and the toe weights 44T can extend in different directions away from the putter body 20, as explained in greater detail below.

Further, in the embodiment illustrated in FIG. 2D, the sole insert 54 is positioned to be substantially flush with the sole surface 56 of the sole region 28. In an alternative embodiment, the sole insert 54 can be positioned to be recessed somewhat from the sole surface 56 of the sole region 28.

Figure 2E:
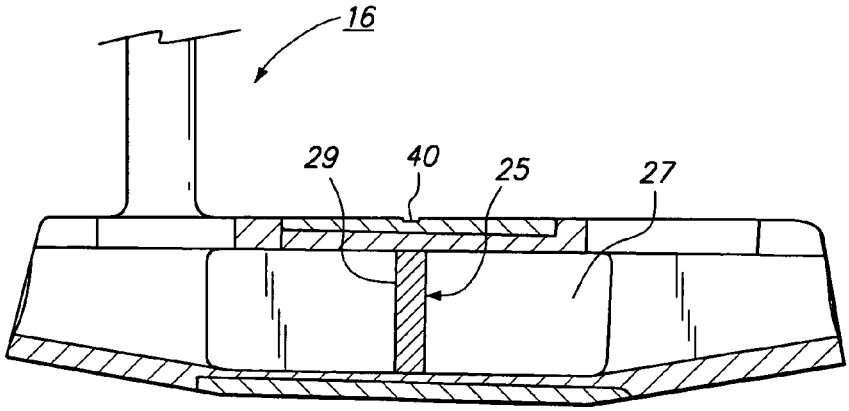
FIG. 2E is a cross-sectional view of a portion of the putter head taken on line 2E—2E in FIG. 2A.

FIG. 2E is a cross-sectional view of the putter head 16 taken on line 2E—2E of FIG. 2A. In this embodiment, the partition wall 29 of the partition member 25 is positioned substantially directly below and in alignment with the alignment guide 40. In this embodiment, the partition insert 27 is illustrated substantially perpendicular to the partition wall 29. In an alternative embodiment, the partition wall 29 can be offset from the alignment guide 40.

Still alternatively, the putter head 16 can include a plurality of partition walls 29. In this embodiment, the two or more of the partition walls 29 can be substantially parallel to each other, and/or substantially parallel with the alignment guide 40.

Figure 3A:
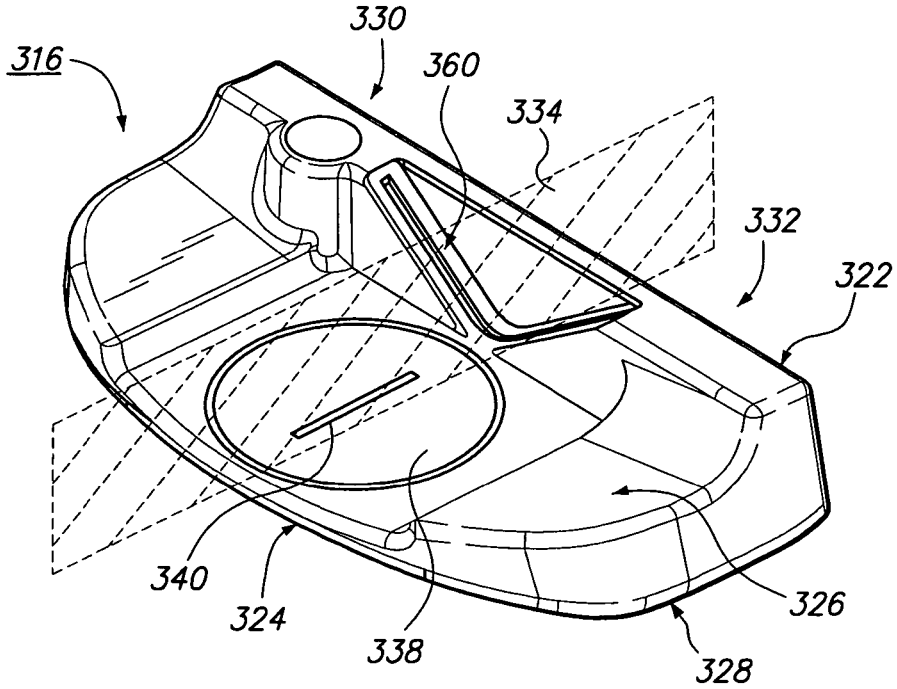
FIG. 3A is a perspective view of a second embodiment of a putter head having features of the present invention.

FIG. 3A is a top perspective view of another embodiment of a putter head 316 having features of the present invention, including a putter body 320. In this embodiment and the embodiments that follow, similarly termed structural components can be similar or identical to those previously described, unless otherwise specified.

In the embodiment illustrated in FIG. 3A, the putter head 316 includes a shaft cavity 300 instead of a hosel 18 (illustrated in FIG. 2A). The shaft (illustrated in FIG. 1) can be inserted into the shaft cavity 300 during construction of the putter 10. In an alternative embodiment, the putter head 316 can include a hosel 18.

Further, in this embodiment, the putter head 316 includes a heel region 330 and a toe region 332 separated or delineated by a centrally positioned transition plane 334 (shown as a dashed plane). Stated another way, the transition plane 334 theoretically divides or demarcates the putter head 316 into the heel region 330 and the toe region 332.

In this embodiment, the putter head 316 includes a face region 322, a back edge 324, an upper region 326 and a sole region 328. The face region 322 includes a generally planar face surface 336 (illustrated in FIG. 3D) for striking a golf ball (not shown). In this embodiment, the back edge 324 is rounded. In alternative embodiments, the back edge 324 can be V-shaped, or can be substantially linear.

In the embodiment illustrated in FIG. 3A, the upper region 326 is on an opposing side of the sole region 328, but is not spaced apart from the sole region 328. Stated another way, the sole region 328 and the upper region 326 are formed as a unitary structure such that there is no gap between the sole region 328 and the upper region 326.

In the embodiment illustrated in FIG. 3A, the upper region 326 and the sole region 328 jointly extend between the face region 322 and the back edge 324. The upper region 326 and the sole region 328 can jointly have a substantially uniform thickness, or can have a thickness that varies, as illustrated in the embodiment in FIG. 3A.

The upper region 326 can also include one or more upper region inserts 338 that are similar in size, shape and composition to the upper region insert 38 (illustrated in FIG. 2A) previously described. The upper region insert 338 can include an alignment guide 340 that assists the golfer in aligning a putt and/or increases the likelihood of a truer putting stroke.

Further, in this embodiment, the putter body 320 includes a V-shaped alignment channel 360. The alignment channel 360 illustrated in FIG. 3A is substantially perpendicular to the orientation of the alignment guide 340. When viewed from the perspective of a golfer using the putter 10, the alignment channel 360 and the alignment guide 340 substantially form a "T" shape. With this design, the golfer can more easily align the putter 10 with the ball before and during a putting stroke in order to obtain more accuracy during a putt. In alternate embodiments, the alignment channel can have a different configuration, such as a U-shape, a W-shape, or another suitable configuration.

Figure 3B:
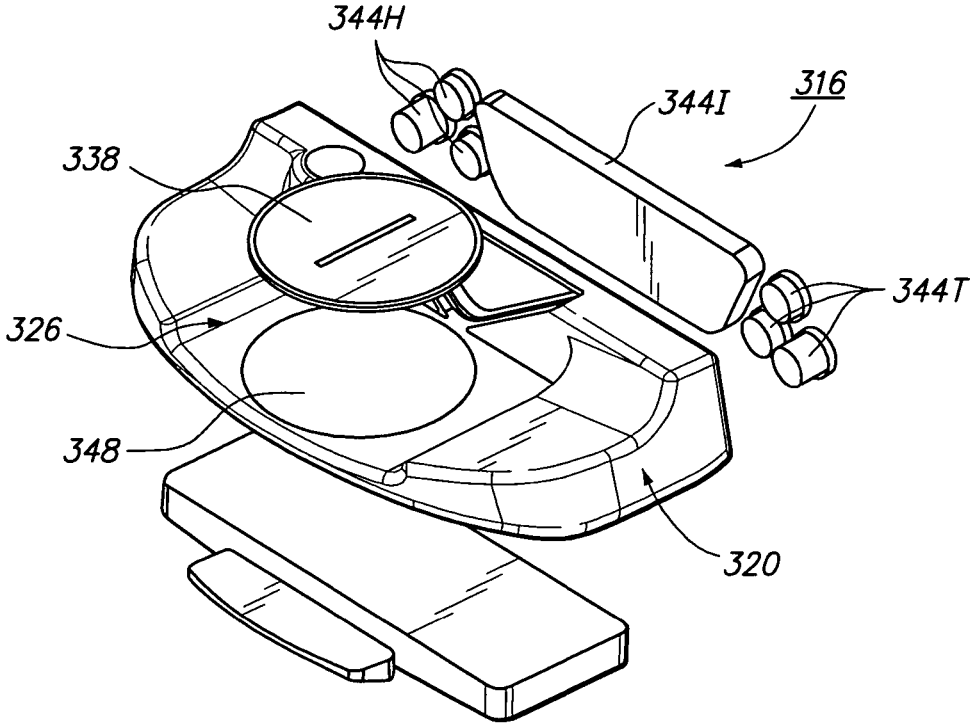
FIG. 3B is an exploded top view of the putter head illustrated in FIG. 3A.

FIG. 3B is an exploded top view of an embodiment of the putter head 316. In the embodiment illustrated in FIG. 3B, the putter head 316 includes one or more heel weights 344H, one or more toe weights 344T and an intermediate face insert 344I that can form a portion of the face surface 336 (illustrated in FIG. 3D). In this embodiment, the putter head 316 includes three different size and/or weight heel weights 344H and three different size and/or weight toe weights 344T. Because of the different weights of heel weights 344H and toe weights 344T, the overall weighting of the putter head 316 can be influenced to provide a lower or higher center of gravity as desired, and/or to provide increased weighting toward the heel 316H and/or the toe 316T, or toward the transition plane 334 (illustrated in FIG. 3A), as desired. It is recognized, however, that greater or fewer than three heel weights 344H and/or toe weights 344T can be used in the putter head 316 provided herein.

The material used to form the heel and toe weights 344H, 344T can affect the balance, center of gravity, and/or moment of inertia of the putter head 316. For example, the heel weights 344H and/or toe weights 344T can be formed substantially from materials having a greater specific gravity than a specific gravity of the material used to substantially form at least a portion of the putter body 320. In one embodiment, the specific gravity of the heel weights 344H and/or toe weights 344T can be at least approximately 50 percent greater than the specific gravity of the putter body 320. In alternative embodiments, the specific gravity of the heel weights 344H and/or toe weights 344T can be at least approximately 100 percent, 150 percent, 200 percent, 250 percent, 300 percent, 350 percent or 400 percent greater than the specific gravity of the putter body 320, as non-exclusive examples. In yet another alternative embodiment, the specific gravity of the heel weights 344H and/or toe weights 344T can be greater or less than the stated percentages relative to the specific gravity of the putter body 320.

For instance, the heel weights 344H and/or toe weights 344T can be formed substantially from tungsten, lead, copper or other suitable materials, as non-exclusive examples. The disparity in specific gravity between the material used to substantially form heel weights 344H and/or toe weights 344T on the one hand, and the material used to substantially form the putter body 320 on the other hand, in conjunction with the size and/or positioning of the heel weights 344H and the toe weights 344T, can provide increased stability of the putter head 316 during putting to inhibit a twisting moment which can result in an errant putt. Further, the shape, size and positioning of the heel weights 344H and the toe weights 344T in conjunction with other components of the putter head 316 can also affect the balance, center of gravity, and/or moment of inertia of the putter head 316, each of which can provide a truer roll and topspin of the golf ball, as explained in greater detail below.

FIG. 3B also illustrates that the upper region 326 also defines an upper region cavity 348 that receives the upper region insert 338. In this embodiment, the upper region cavity 348 is sized and shaped to accommodate the upper region insert 338.

Figure 3C:
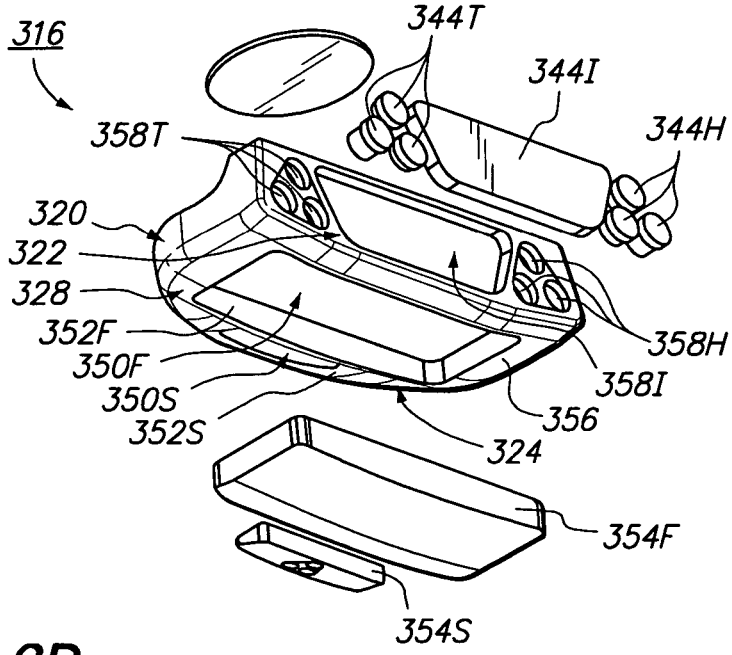
FIG. 3C is an exploded bottom view of the putter head illustrated in FIG. 3A.

FIG. 3C is a bottom exploded view of the putter head 316 illustrated in FIG. 3A. In this embodiment, the putter body 320 includes one or more heel cavities 358H that each receives one of the heel weights 344H. Additionally, the putter body 320 includes one or more toe cavities 358T that each receives one of the toe weights 344T. Further, the putter body 320 includes an intermediate face cavity 358I that receives the intermediate face insert 344I.

Further, in this embodiment, the putter head 316 can include one or more sole cavities positioned within the sole region 328, including a first sole cavity 350F and a second sole cavity 350S. It is recognized that the positioning and dimensions of the sole cavities 350F, 350S can vary from the embodiments illustrated herein depending upon the design requirements of the golf putter 10 and the putter head 316. In this embodiment, the first sole cavity 350F can have a first sole cavity perimeter 352F that is defined entirely within the sole region 328. In other words, in this embodiment, the first sole cavity perimeter 352F of the first sole cavity 350 does not extend to the face region 322 or the back edge 324 of the putter head 316.

Moreover, in this embodiment, the second sole cavity 350S can have a second sole cavity perimeter 352S that is defined entirely within the sole region 328. In other words, in this embodiment, the second sole cavity perimeter 352S of the second sole cavity 350S does not extend to the face region 322 or the back edge 324 of the putter head 316. In an alternative embodiment, one or more of the sole cavity perimeters 352F, 352S of the sole cavity 350 can extend to the face region 322 and/or the back edge 324 of the putter head 316.

In this embodiment, the first sole cavity 350F has a generally rectangular footprint. However, any geometry can be used. For example, the footprint of the first sole cavity 350 can be oval, circular, triangular, or any other suitable polygonal shape. Additionally, the depth of the first sole cavity 350F illustrated in FIG. 3C is substantially uniform. However, the depth of the first sole cavity 350F can vary. For instance, the first sole cavity 350F can be substantially wedge-shaped, concave, convex, U-shaped, V-shaped, or can have another suitable configuration.

The second sole cavity 350S in the embodiment illustrated in FIG. 3C has a somewhat rectangular footprint, although one of the sides of the second sole cavity 350S approximately follows the contour of the back edge 324 of the putter body 320. It is recognized that any suitable geometry can be used for the second sole cavity 350S. Additionally, in this embodiment, the depth of the second sole cavity 350S is not uniform, but is somewhat wedge-shaped. Alternatively, the depth of the second sole cavity 350S can be substantially uniform, concave, convex, U-shaped, V-shaped, or can have another suitable configuration.

In the embodiment illustrated in FIG. 3C, the putter head 316 includes a first sole insert 354F that is inserted into the first sole cavity 350F. Somewhat similarly to the first sole cavity 350F, the positioning and dimensions of the first sole insert 354F can vary. In this embodiment, an exposed surface of the first sole insert 354F is substantially flush with a sole surface 356 of the sole region 328. Stated another way, regardless of the shape of the sole surface 356, the first sole insert 354F can follow the contour of the sole surface 356 to provide a smooth sole region 328 that moves along a putting surface during putting. In an alternative embodiment, the first sole insert 354F can be recessed from the sole surface 356 or can extend away from the sole surface 356.

The materials used to form the first sole insert 354F can vary. For example, in this embodiment, the first sole insert 354F can be formed from a relatively lightweight material such as polyurethane, other plastic materials, ceramic, wood or epoxy compounds. In this embodiment, the first sole insert 354F can be formed substantially from a material having a specific gravity that is lower than a specific gravity of the material used to substantially form the putter body 320. Thus, because of the somewhat central positioning of the first sole insert 354F relative to the putter body 320, the weighting of the putter head 316 is distributed more toward the heel region 330, the toe region 332 and the back edge 324 (e.g., the perimeter) of the putter head 316, and less in the interior of the putter head 316. With this design, the moment of inertia upon striking a golf ball is increased, resulting in a decreased likelihood of the putter head 316 twisting on impact.

In alternative embodiments, the specific gravity of the material that forms the first sole insert 354F is less than approximately 90%, 75%, 50%, 40%, 30%, 25%, 20%, 15% or 10% of the specific gravity of the putter body 320. For example, in one embodiment, the specific gravity of a stainless steel putter body 320 can be approximately 7,500–8,000 kg/m$^3$, and the specific gravity of a polyurethane material used to substantially form the first sole insert 354F can be approximately 1,200–1,500 kg/m$^3$ (approximately 15–20% of the specific gravity of the putter body 20) depending upon the precise materials used to form the polyurethane first sole insert 354F. It is recognized that the foregoing example is provided for representative purposes only, and is not intended to limit the types of materials that can be used with the present invention.

Still alternatively, the first sole insert 354F can be formed from a relatively heavy material, such as various metal alloys, ceramics, or other suitable materials. In this embodiment, the material used to substantially form the first sole insert 354F can have a specific gravity that is greater than the specific gravity of the material used to substantially form the putter body 320.

The first sole insert 354F can be positioned so that at least a portion of the first sole insert 354F is within the heel region 330, and at least a portion is within the toe region 332. In another embodiment, the first sole insert 354F is positioned substantially symmetrically relative to the transition plane 334.

The first sole insert 354F can be adhered to the putter body 320 using any one of a variety of methods. For example, the first sole insert 354F can be adhesively secured to the first sole cavity 350F of the putter body 320. Alternatively, the first sole insert 354F can be welded, or can include a top coat (not shown) of plastic or other material that secures the first sole insert 354F within the first sole cavity 350F. Further, the first sole insert 354F can be removably snapped or otherwise held into place within the first sole cavity 350F. It is recognized that any suitable method can be used to secure the first sole insert 354F to the putter body 320, and that the foregoing examples are merely provided as non-exclusive, representative methods.

Additionally, in the embodiment illustrated in FIG. 3C, the putter head 316 includes a second sole insert 354S that is inserted into the second sole cavity 350S. As used herein, the first sole insert 354F and the second sole insert 354S can be interchangeable so that either sole insert 354F, 354S can be the first sole insert 354F or the second sole insert 354S.

Somewhat similarly to the second sole cavity 350S, the positioning and dimensions of the second sole insert 354S can vary. In this embodiment, an exposed surface of the second sole insert 354S is substantially flush with a sole surface 356 of the sole region 328. Regardless of the shape of the sole surface 356, the second sole insert 354S can follow the contour of the sole surface 356 to provide a smooth sole region 328 that moves along a putting surface during putting. In an alternative embodiment, the second sole insert 354S can be recessed from the sole surface 356 or can extend away from the sole surface 356.

The materials used to form the second sole insert 354S can vary. For example, in this embodiment, the second sole insert 354S can be formed from a relatively heavy material such as a metal alloy. In alternative embodiments, the second sole insert 354S is formed at least partially from tungsten, copper, lead, or other metals having a relatively high specific gravity. In this embodiment, the second sole insert 354S can have a specific gravity that is higher than a specific gravity of the first sole insert 354F and the putter body 320. Thus, the weighting of the putter head 316 is altered so that more of the weight of the putter head is distributed toward the heel region 330, the toe region 332 and near the back edge 324 and sole region 328 of the putter head 316. With this design, the moment of inertia upon striking a golf ball is increased, resulting in a decreased likelihood of the putter head 316 twisting on impact.

In alternative embodiments, the specific gravity of the material that substantially forms the second sole insert 354S is at least approximately 25%, 50%, 75%, 100%, 150%, 200%, 250% or 300% greater than the specific gravity of the material used to substantially form the putter body 320. Moreover, in alternative embodiments, the specific gravity of the material that forms the second sole insert 354S is at least approximately 100%, 200%, 300%, 400%, 500%, 600%, 700%, 800%, 900%, 1,000%, 1,200%, 1,400%, 1,500% greater than the specific gravity of the first sole insert 354F.

For example, in one embodiment, the specific gravity of a stainless steel putter body 320 can be approximately 7,500–8,000 kg/m$^3$, and the specific gravity of the second sole insert 354S can be approximately 19,200 kg/m$^3$ (approximately 250% of the specific gravity of the putter body 20) depending upon the precise materials used to form the second sole insert 354S. As another example, the specific gravity of the first sole insert 354F formed from a polyurethane material can be approximately 1,200 to 1,500 kg/m$^3$, and the specific gravity of the second sole insert 354S can be approximately 19,200 kg/m$^3$ (approximately 1,600% of the specific gravity of the first sole insert 354F), depending upon the precise materials used to form the first sole insert 354F and the second sole insert 354S. With this design, more of the weight is distributed toward the perimeter of the putter head 316, which provides an increased moment of inertia for better control of the putter head 316 on impact with the golf ball. It is recognized that the foregoing examples are provided for representative purposes only, and are not intended to limit the types of materials that can be used with the present invention.

Still alternatively, the second sole insert 354S can be formed from a relatively lightweight material, such as various plastics, epoxies, wood or other suitable materials. In this embodiment, the material used to substantially form the second sole insert 354S can have a specific gravity that is lower than the specific gravity of the material used to substantially form the putter body 320. The second sole insert 354S can be adhered to the putter body 320 in a somewhat similar manner as the first sole insert 354F.

Moreover, the second sole insert 354S can have a different geometry, volume, weight, density and/or dimensions from the first sole insert 354F depending upon the design requirements of the putter 10 and/or the putter head 316. For example, in alternative embodiments, the second sole insert 354S can have a volume that is less than approximately 90%, 80%, 75%, 60%, 50%, 40%, 30%, 25% or 10% of the volume of the first sole insert 354F. Further, the weight of the second sole insert 354S can be at least approximately 50%, 100%, 150%, 200%, 300%, 400%, 500%, 750%, 1,000% greater than a weight of the first sole insert 354F. In another embodiment, however, the second sole insert 354S can have a weight that is lower than the weight of the first sole insert 354F.

The second sole insert 354S can be positioned so that at least a portion of the second sole insert 354S is within the heel region 330, and at least a portion is within the toe region 332. In another embodiment, the second sole insert 354S is positioned substantially symmetrically relative to the transition plane 334, as illustrated in FIGS. 3A and 3D, for example.

Figure 3D:
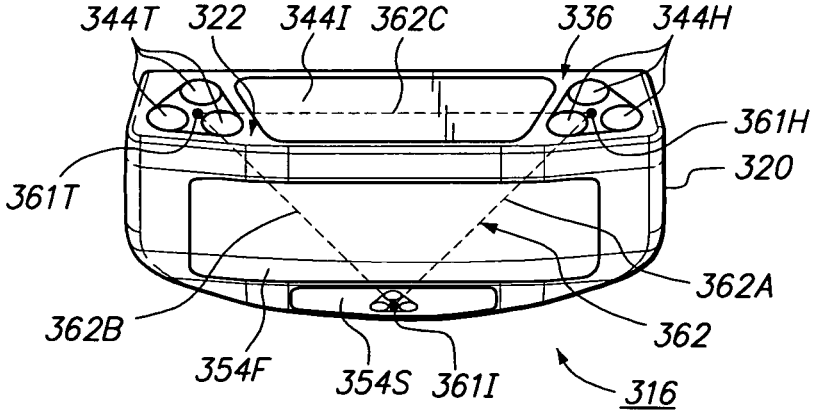
FIG. 3D is a bottom perspective view of the putter head illustrated in FIG. 3A.

FIG. 3D is a bottom perspective view of the putter head 316 illustrated in FIG. 3A. In this embodiment, the heel weights 344H, toe weights 344T, and intermediate face insert 344I are each positioned to be substantially flush with the face surface 336 of the face region 322. Alternatively, the heel weights 344H, toe weights 344T, and intermediate face insert 344I can be positioned to be recessed somewhat from the face surface 336 of the face region 322, or can be positioned on or near other locations of the putter body 320.

Further, in the embodiment illustrated in FIG. 3D, the one or more heel weights 344H and the one or more toe weights 344T each has a center of gravity. Moreover, each of the sole inserts 354F, 354S has a center of gravity. In one embodiment, the center of gravity 361H of the one or more heel weights 344H, the center of gravity 361T of the one or more toe weights 344T and the center of gravity 361I of one of the sole inserts 354F, 354S form the vertices of a triangle 362 (shown as a dashed line) wherein two of the sides of the triangle 362 have a substantially similar length.

In the embodiment illustrated in FIG. 3D, the triangle 362 has sides 362A, 362B, 362C. In this embodiment, side 362A and side 362B are substantially similar in length. In one embodiment, the sides 362A, 362B are identical in length. As used herein, the sides 362A–C are interchangeable. That is, any of the sides can be side 362A, 362B or 362C. In an alternative embodiment, the three centers of gravity that form the triangle 362 can be formed by (i) a single center of gravity of one of the heel weights 344H, (ii) a single center of gravity of one of the toe weights 344T, and (iii) one of the sole inserts 354F, 354S.

Figure 3E:
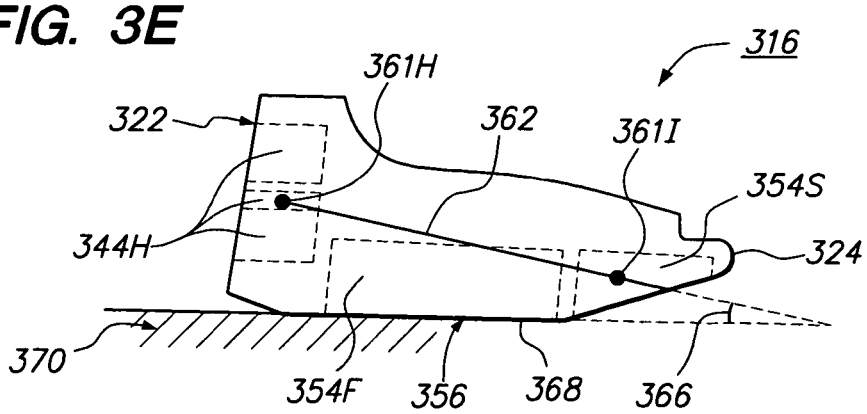
FIG. 3E is a side view of the putter head illustrated in FIG. 3A.

FIG. 3E is a side view of the putter head 316 illustrated in FIG. 3A. FIG. 3E illustrates that the triangle 362 (shown as a line) formed by the center of gravity 361H of the heel weights 344H, the center of gravity 361T of the toe weights 344T (not shown in FIG. 3E for clarity), and the center of gravity 361I of the second sole insert 354S defines a plane 364 (shown as a line) that forms an angle 366 with a sole contact surface 368 that is greater than zero degrees. Stated another way, the centers of gravity 361H, 361T, 361I can define a plane 364 that slopes downwardly moving in a direction from the face region 322 toward the back edge 324. As used herein, the sole contact surface 368 is defined as a portion of the sole surface 356 that is substantially parallel to a ground surface 370 (such as a putting green) during putting.

The angle 366 can be varied depending upon the design requirements of the putter 10 and the putter head 316. In one embodiment, the angle 366 is at least approximately as great as an angle formed between the face surface 336 of the face region 322 relative to vertical. Thus, in this embodiment, if the face surface 336 angle relative to vertical is five degrees, the angle 366 is at least approximately five degrees. In an alternative embodiment, the angle 366 can be within the range of between greater than approximately five degrees and less than approximately 45 degrees. In an alternative embodiment, the angle 366 can be greater than approximately eight degrees and less than approximately 30 degrees. In another embodiment, the angle 366 can be greater than approximately ten degrees and less than approximately 20 degrees. In yet another embodiment, the angle 366 can be approximately 15 degrees. However, any suitable angle 366 can be used. With these designs, the putter head 316 can generate increased overspin and improved loft of the ball on impact, thereby decreasing the likelihood of skipping or skidding across the ground surface 370.

Figure 4A:
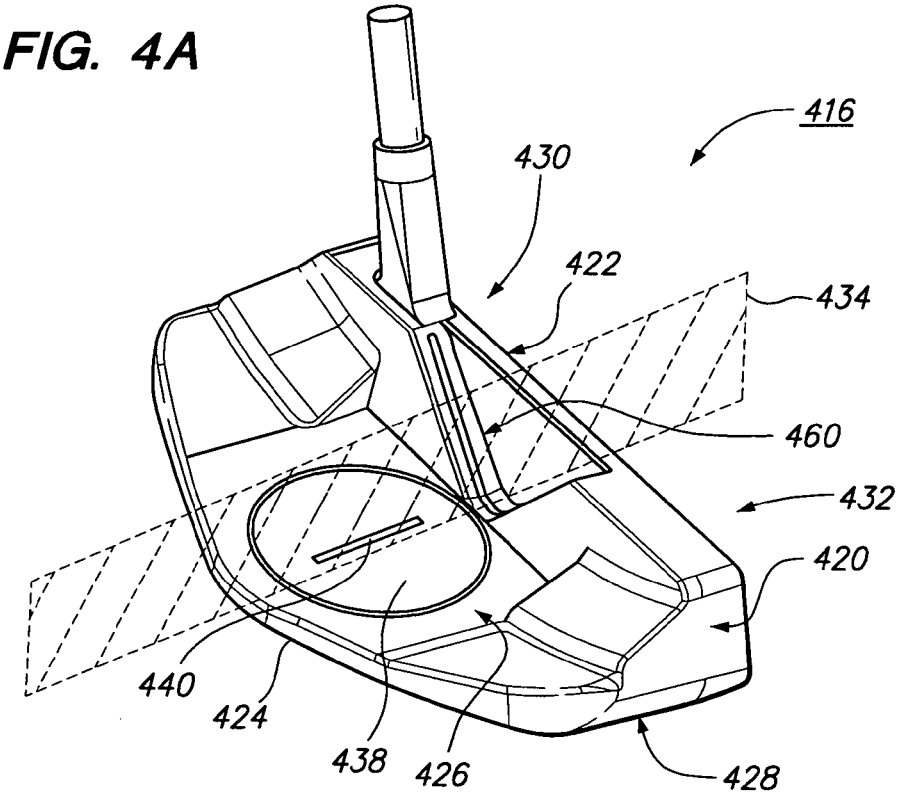
FIG. 4A is a perspective view of a third embodiment of a putter head having features of the present invention.

FIG. 4A illustrates another embodiment of a putter head 416 having features of the present invention. In this embodiment, the putter head 416 includes a heel region 430 and a toe region 432 separated by a centrally positioned transition plane 434 (shown as a dashed plane). Stated another way, the transition plane 434 theoretically divides or demarcates the putter head 416 into the heel region 430 and the toe region 432.

In this embodiment, the putter head 416 includes a face region 422, a back edge 424, an upper region 426 and a sole region 428. The face region 422 includes a generally planar face surface 436 (illustrated in FIG. 4C) for striking a golf ball (not shown). In this embodiment, the back edge 424 is somewhat V-shaped. In alternative embodiments, the back edge 424 can be rounded, or can be substantially linear.

The upper region 426 can also include one or more upper region inserts 438 that are similar in size, shape and composition to the upper region insert 38 (illustrated in FIG. 2A) previously described. The upper region insert 438 can include an alignment guide 440 that assists the golfer in aligning a putt and/or increases the likelihood of a truer putting stroke.

Further, in this embodiment, the putter body 420 includes a V-shaped (or other suitably shaped) alignment channel 460. The alignment channel 460 illustrated in FIG. 4A is substantially perpendicular to the orientation of the alignment guide 440.

Figure 4B:
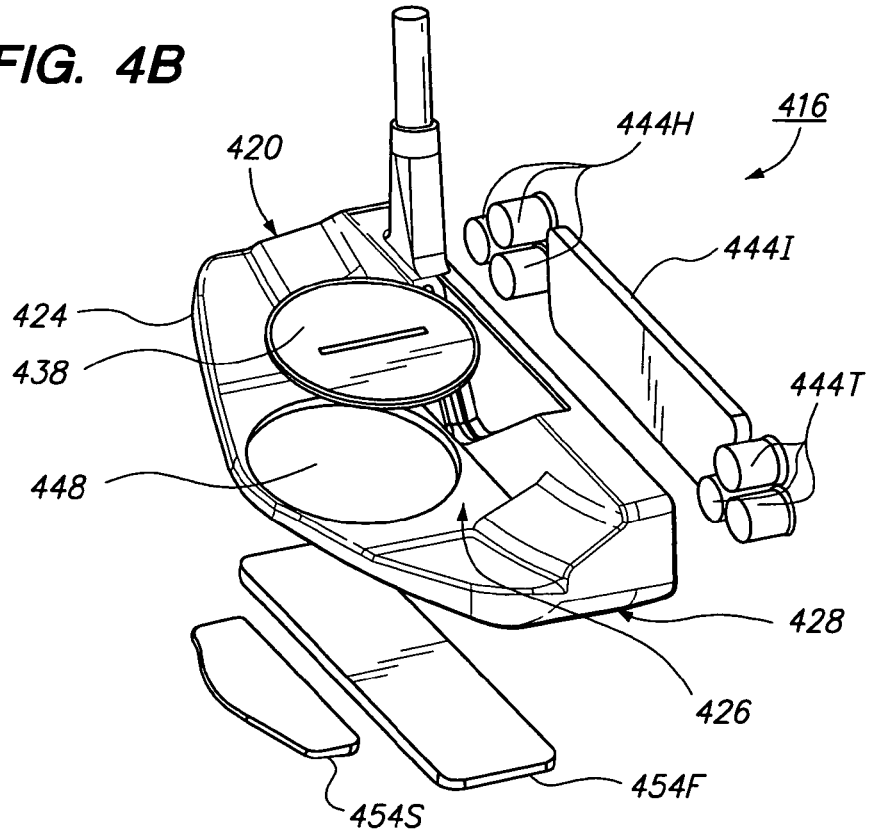
FIG. 4B is an exploded view of the putter head illustrated in FIG. 4A.

FIG. 4B is an exploded top view of the putter head 416 illustrated in FIG. 4A. In the embodiment illustrated in FIG. 4B, the putter head 416 includes one or more heel weights 444H, one or more toe weights 444T and an intermediate face insert 444I that can form a portion of the face surface 436 (illustrated in FIG. 4C). The heel weights 444H, the toe weights 444T and the intermediate face insert 444I illustrated in FIG. 4B can be formed, sized, shaped and positioned somewhat similarly to those described in previous embodiments.

FIG. 4B also illustrates that the upper region 426 also defines an upper region cavity 448 that receives the upper region insert 438. In this embodiment, the upper region cavity 448 is sized and shaped to accommodate the upper region insert 438.

In the embodiment illustrated in FIG. 4B, the putter head 416 includes a first sole insert 454F and a second sole insert 454S. The positioning and dimensions of the sole inserts 454F, 454S can vary. The materials used to form the sole inserts 454F, 454S can vary. For example, in this embodiment, the first sole insert 454F can be formed from a relatively lightweight material such as polyurethane, other plastic materials, ceramic, wood or epoxy compounds. In alternative embodiments, the specific gravity of the material that forms the first sole insert 454F is less than approximately 90%, 75%, 50%, 40%, 30%, 25%, 20%, 15% or 10% of the specific gravity of the putter body 420.

The second sole insert 454S can be formed from a different material from the first sole insert 454F. In one embodiment, the second sole insert 454S is formed from a material having a greater specific gravity than the first sole insert 454F. For example, in this embodiment, the second sole insert 454S can be formed from a relatively heavy material such as a metal alloy. In alternative embodiments, the second sole insert 454S is formed at least partially from tungsten, copper, lead, or other metals having a relatively high specific gravity.

In this embodiment, the second sole insert 454S can have a specific gravity that is higher than a specific gravity of the first sole insert 454F and the putter body 420. Thus, the weighting of the putter head 416 is altered so that more of the weight of the putter head is distributed toward the heel region 430 (illustrated in FIG. 4A), the toe region 432 (illustrated in FIG. 4A) and near the back edge 424 and sole region 428 of the putter head 416. With this design, the moment of inertia upon striking a golf ball is increased, resulting in a decreased likelihood of the putter head 416 twisting on impact.

Further, the shape of the second sole insert 454S can be varied. In one embodiment, the second sole insert 454S can be somewhat wedge shaped. Further, the second sole insert 454S can have a substantially pentagonal footprint, as illustrated in FIG. 4B. However, it is recognized that the shape and size of the second sole insert 454S can be any suitable configuration provided that the weighting of the putter head 416 is consistent with the intent set forth herein.

In alternative embodiments, the specific gravity of the material that substantially forms the second sole insert 454S is at least approximately 25%, 50%, 75%, 100%, 150%, 200%, 250% or 300% greater than the specific gravity of the material used to substantially form the putter body 420. Moreover, in alternative embodiments, the specific gravity of the material that forms the second sole insert 454S is at least approximately 100%, 200%, 300%, 400%, 500%, 600%, 700%, 800%, 900%, 1,000%, 1,200%, 1,400%, 1,500% greater than the specific gravity of the first sole insert 454F. With this design, more of the weight is distributed toward the perimeter of the putter head 416, which provides an increased moment of inertia for better control of the putter head 416 on impact with the golf ball. It is recognized that the foregoing examples are provided for representative purposes only, and are not intended to limit the types of materials that can be used with the present invention.

Figure 4C:
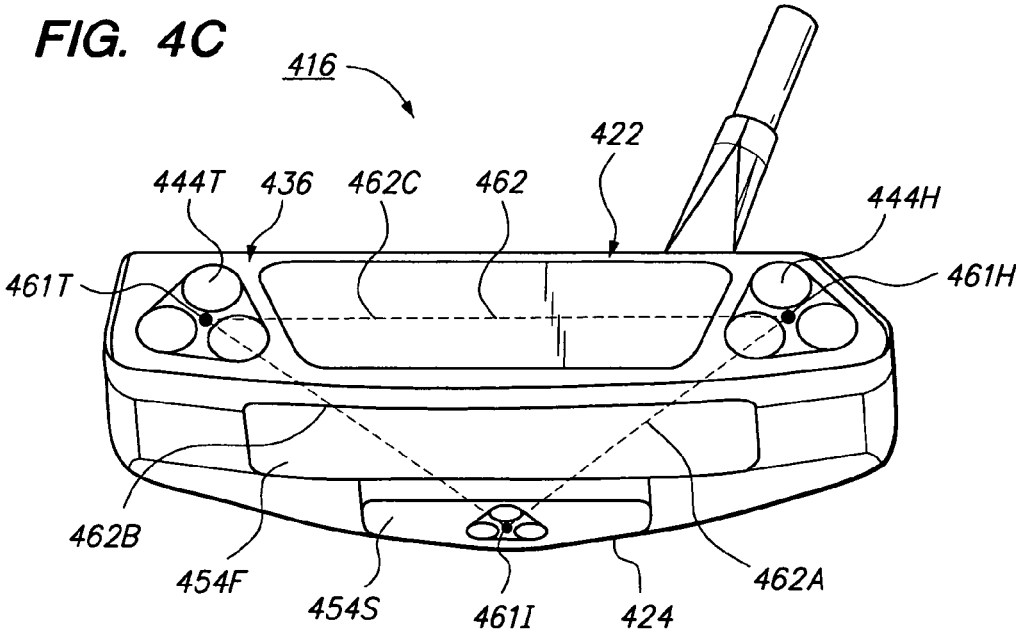
FIG. 4C is a bottom perspective view of the golf putter head illustrated in FIG. 4A.

FIG. 4C is a bottom perspective view of the putter head 416 illustrated in FIG. 4A. In this embodiment, the one or more heel weights 444H and the one or more toe weights 444T each has a center of gravity. Moreover, each of the sole inserts 454F, 454S has a center of gravity. In one embodiment, the center of gravity 461H of the one or more heel weights 444H, the center of gravity 461T of the one or more toe weights 444T and the center of gravity 461I of one of the sole inserts 454F, 454S form the vertices of a triangle 462 (shown as a dashed line) wherein two of the sides of the triangle 462 have a substantially similar length.

In the embodiment illustrated in FIG. 4C, the triangle 462 has sides 462A, 462B, 462C. In this embodiment, side 462A and side 462B are substantially similar in length. In one embodiment, the sides 462A, 462B are identical in length. In an alternative embodiment, the three centers of gravity 461H, 461T, 461I that form the triangle 462 can be formed by (i) a single center of gravity of one of the heel weights 444H, (ii) a single center of gravity of one of the toe weights 444T, and (iii) one of the sole inserts 454F, 454S. Somewhat similarly to other embodiments described herein, the centers of gravity 461H, 461T, 461I can define a plane (not shown) that slopes downwardly moving in a direction from the face region 422 toward the back edge 424. With this design, the putter head 416 can generate increased topspin and improved loft of the ball on impact.

Figure 5A:
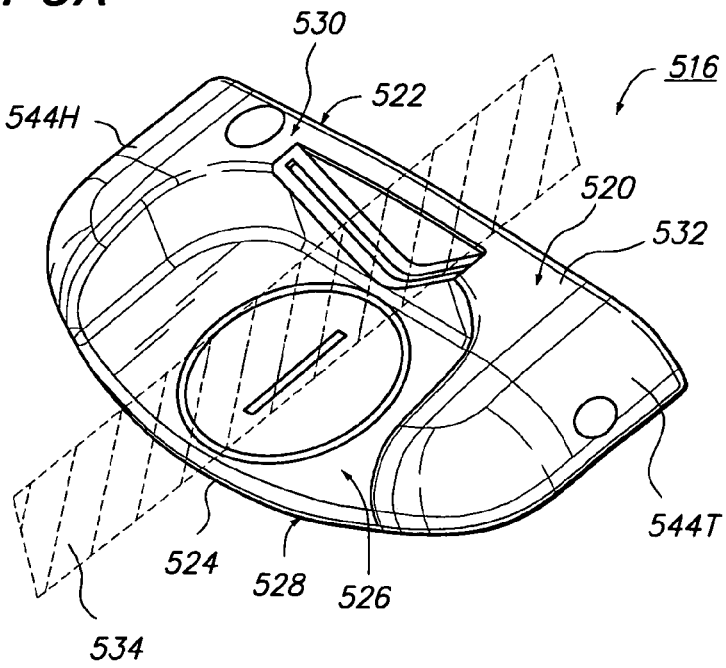
FIG. 5A is a perspective view of a fourth embodiment of a golf putter head having features of the present invention.

FIG. 5A illustrates another embodiment of a putter head 516 having features of the present invention, including a putter body 520. In this embodiment, the putter head 516 includes a face region 522, a back edge 524, an upper region 526 and a sole region 528. In this embodiment, the back edge 524 is somewhat rounded. In alternative embodiments, the back edge 524 can have another suitable shape.

The putter head 516 includes a heel region 530 and a toe region 532 separated by a centrally positioned transition plane 534 (shown as a dashed plane). Stated another way, the transition plane 534 theoretically divides or demarcates the putter head 516 into the heel region 530 and the toe region 532. In this embodiment, the putter head 516 also includes a heel weight 544H and a toe weight 544T that are secured to the putter body 520.

In the embodiment illustrated in FIG. 5A, the heel weight 544H and the toe weight 544T can form a portion of the face surface 536 (illustrated in FIG. 5C) and/or the back edge 524. Moreover, in this embodiment, the heel weight 544H can include the heel 516H, and the toe weight 544T can include the toe 516T.

The material(s) used to form the heel and toe weight 544H, 544T can affect the balance, center of gravity, and/or moment of inertia of the putter head 516. For example, the heel weight 544H and/or toe weight 544T can be formed substantially from materials having a greater specific gravity than a specific gravity of the material used to substantially form at least a portion of the putter body 520. In one embodiment, the specific gravity of the heel weight 544H and/or toe weight 544T can be at least approximately 50 percent greater than the specific gravity of the putter body 520. In alternative embodiments, the specific gravity of the heel weight 544H and/or toe weight 544T can be at least approximately 100 percent, 150 percent, 200 percent, 250 percent, 300 percent, 350 percent or 400 percent greater than the specific gravity of the putter body 520, as non-exclusive examples. In yet another alternative embodiment, the specific gravity of the heel weight 544H and/or toe weight 544T can be greater or less than the stated percentages relative to the specific gravity of the putter body 520.

For instance, the heel weight 544H and/or toe weight 544T can be formed substantially from tungsten, lead, copper or other suitable materials, as non-exclusive examples. The disparity in specific gravity between the material used to substantially form heel weight 544H and/or toe weight 544T on the one hand, and the material used to substantially form the putter body 520 on the other hand, in conjunction with the size and/or positioning of the heel weight 544H and the toe weight 544T, can provide increased stability of the putter head 516 during putting to inhibit a twisting moment which can result in an errant putt. Further, the shape, size and positioning of the heel weight 544H and the toe weight 544T in conjunction with other components of the putter head 516 can also affect the balance, center of gravity, and/or moment of inertia of the putter head 516, each of which can provide a truer roll and topspin of the golf ball.

Figure 5B:
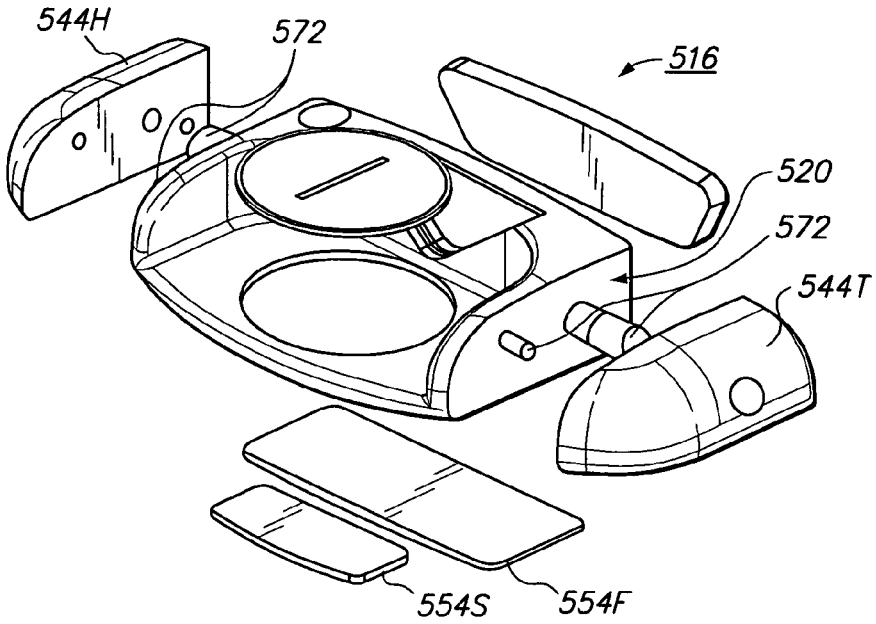
FIG. 5B is an exploded view of the golf putter head illustrated in FIG. 5A.

FIG. 5B is an exploded top view of the putter head 516 illustrated in FIG. 5A. The heel weight 544H and the toe weight 544T can be secured to the putter body 520 by various means. For example, the heel weight 544H can be secured to the putter body 520 using one or more pins 572 that extend into the heel weight 544H and/or the putter body 520. Alternatively, the heel weight 544H can be welded, adhesively applied or secured to the putter body 520 by other suitable methods. Somewhat similarly, the toe weight 544T can likewise be secured to the putter body 520.

In the embodiment illustrated in FIG. 5B, the putter head 516 includes a first sole insert 554F and a second sole insert 554S. The positioning and dimensions of the sole inserts 554F, 554S can vary. The materials used to form the sole inserts 554F, 554S can vary. For example, in this embodiment, the first sole insert 554F can be formed from a relatively lightweight material such as polyurethane, other plastic materials, ceramic, wood or epoxy compounds. In alternative embodiments, the specific gravity of the material that forms the first sole insert 554F is less than approximately 90%, 75%, 50%, 40%, 30%, 25%, 20%, 15% or 10% of the specific gravity of the putter body 520.

The second sole insert 554S can be formed from a different material from the first sole insert 554F. In one embodiment, the second sole insert 554S is formed from a material having a greater specific gravity than the first sole insert 554F. For example, in this embodiment, the second sole insert 554S can be formed from a relatively heavy material such as a metal alloy. In alternative embodiments, the second sole insert 554S is formed at least partially from tungsten, copper, lead, or other metals having a relatively high specific gravity.

In this embodiment, the second sole insert 554S can be formed from a material having a specific gravity that is higher than a specific gravity of the material used to form the first sole insert 554F and/or the putter body 520. Thus, the weighting of the putter head 516 is altered so that more of the weight of the putter head 516 is distributed toward the heel region 530 (illustrated in FIG. 5A), the toe region 532 (illustrated in FIG. 5A) and near the back edge 524 and sole region 528 of the putter head 516. With this design, the moment of inertia upon striking a golf ball is increased, resulting in a decreased likelihood of the putter head 516 twisting on impact.

In alternative embodiments, the specific gravity of the material that substantially forms the second sole insert 554S is at least approximately 25%, 50%, 75%, 100%, 150%, 200%, 250% or 300% greater than the specific gravity of the material used to substantially form the putter body 520. Moreover, in alternative embodiments, the specific gravity of the material that forms the second sole insert 554S is at least approximately 100%, 200%, 300%, 400%, 500%, 600%, 700%, 800%, 900%, 1,000%, 1,200%, 1,400%, 1,500% greater than the specific gravity of the material that forms the first sole insert 554F. With this design, more of the weight is distributed toward the perimeter of the putter head 516, which provides an increased moment of inertia for better control of the putter head 516 on impact with the golf ball. It is recognized that the foregoing examples are provided for representative purposes only, and are not intended to limit the types of materials that can be used with the present invention.

Figure 5C:
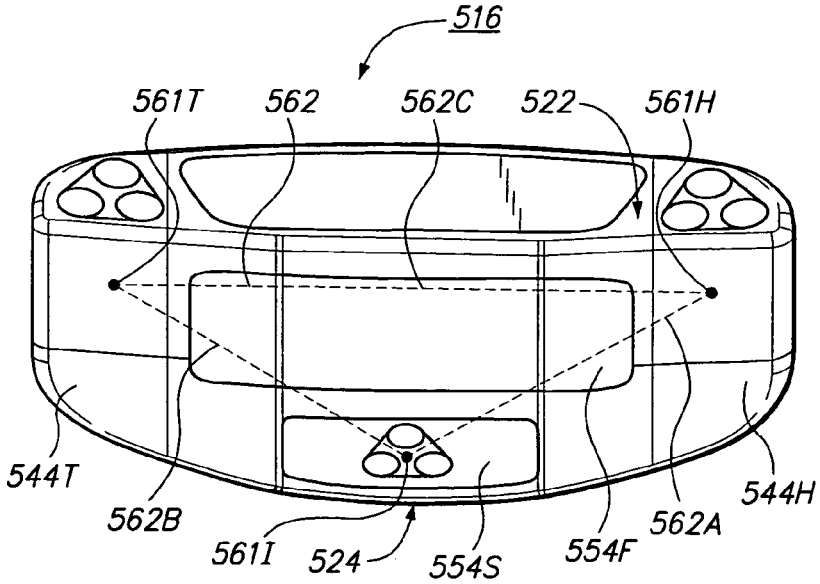
FIG. 5C is a bottom perspective view of the golf putter head illustrated in FIG. 5A.

FIG. 5C is a bottom perspective view of the putter head 516 illustrated in FIG. 5A. In this embodiment, the heel weight 544H and the toe weight 544T each has a center of gravity. Moreover, each of the sole inserts 554F, 554S has a center of gravity. In one embodiment, the center of gravity 561H of the heel weight 544H, the center of gravity 561T of the toe weight 544T and the center of gravity 561I of one of the second sole insert 554S form the vertices of a triangle 562 (shown as a dashed line) wherein two of the sides of the triangle 562 have a substantially similar length.

In the embodiment illustrated in FIG. 5C, the triangle 562 has sides 562A, 562B, 562C. In this embodiment, side 562A and side 562B are substantially similar in length. In one embodiment, the sides 562A, 562B are identical in length. In an alternative embodiment, the three centers of gravity 561H, 561T, 561I that form the triangle 562 can be formed by (i) a single center of gravity of the heel weight 544H, (ii) a single center of gravity of the toe weight 544T, and (iii) the second sole insert 554S. Somewhat similarly to other embodiments described herein, the centers of gravity 561H, 561T, 561I can define a plane (not shown) that slopes downwardly moving in a direction from the face region 522 toward the back edge 524. With this design, the putter head 516 can generate increased topspin and improved loft of the ball on impact, with decreased incidence of skidding or skipping across the ground surface.

While the particular golf putter 10 and putter heads 16 as herein shown and disclosed in detail are fully capable of obtaining the objects and providing the advantages herein before stated, it is to be understood that they are merely illustrative of some of the presently preferred embodiments of the invention and that no limitations are intended to the details of construction or design herein shown other than as described in the appended claims.

What is claimed is:

1. A golf putter for putting a ball along a surface, the golf putter comprising:

a putter body having a centrally positioned transition plane that demarcates the putter body into a heel region and a toe region, the putter body being formed substantially from a material having a first specific gravity, the putter body including (i) a sole region that defines a first sole cavity, (ii) a face region that strikes the ball during putting, and (iii) a back region;

a heel weight that is secured to the heel region, the heel weight being formed substantially from a material having a second specific gravity that is greater than the first specific gravity, the heel weight having a center of gravity;

a toe weight that is secured to the toe region, the toe weight being spaced apart from the heel weight, the toe weight being formed substantially from a material having a third specific gravity that is greater than the first specific gravity, the toe weight having a center of gravity; and a first sole insert that is inserted into the first sole cavity, the first sole insert being formed substantially from a material having a fourth specific gravity that is greater than the first specific gravity, the first sole insert having a center of gravity;

wherein the center of gravity of the heel weight, the toe weight and the first sole insert form vertices of a triangle having two sides that are approximately the same length, the triangle defining a plane that is angled in a downwardly direction moving from the face region toward the back region when the sole insert is in contact with the surface.

2. A golf putter for putting a ball along a surface, the golf putter comprising:

a putter body having a centrally positioned transition plane that demarcates the putter body into a heel region and a toe region, the putter body including a sole region that defines a first sole cavity having a first volume and a second sole cavity having a second volume that is greater than the first volume, at least one of the sole cavities being positioned partly in the heel region and partly in the toe region;

a first sole insert that is inserted into the first sole cavity; and a second sole insert that is inserted into the second sole cavity.

3. The golf putter of claim 2 wherein the second sole insert is substantially formed from a material having a specific gravity that is at least approximately 100% greater than the specific gravity of a material that substantially forms the first sole insert.

4. The golf putter of claim 2 wherein the second sole insert is substantially formed from a material having a specific gravity that is at least approximately 500% greater than the specific gravity of a material that substantially forms the first sole insert.

5. The golf putter of claim 2 wherein at least one of the sole inserts is formed substantially from a material having a specific gravity that is greater than a specific gravity of a material used to substantially form the putter body.

6. The golf putter of claim 2 wherein the putter body includes a face region that is adapted to strike the ball while putting, and wherein the second sole insert is positioned further from the face region than the first sole insert.

7. The golf putter of claim 2 wherein the putter body has a centrally positioned transition plane that demarcates the putter body into a heel region and a toe region, the golf putter further comprising (i) a heel weight that is secured to the heel region, the heel weight being formed substantially from a material having a specific gravity that is greater than a specific gravity of a material used to substantially form the putter body, and (ii) a toe weight that is secured to the toe region, the toe weight being spaced apart from the heel weight, the toe weight being formed substantially from a material having a specific gravity that is greater than the specific gravity of the material used to substantially form the putter body.

8. The golf putter of claim 7 wherein the heel weight, the toe weight and the first sole insert each includes a center of gravity, and wherein the center of gravity of the heel weight, the toe weight and the first sole insert form vertices of a triangle having two sides that are approximately the same length.

9. The golf putter of claim 8 wherein the putter body includes a face region that strikes the ball during putting and a back region, and wherein the triangle defines a plane that slopes in a downward direction moving from the face region toward the back region when one of the sole inserts is in contact with the surface.

10. The golf putter of claim 2 wherein the second sole insert has a volume that is less than 50% of a volume of the first sole insert.

11. The golf putter of claim 2 wherein the putter body includes a face region that is adapted to strike the ball during putting, and wherein the entire second sole insert is positioned further from the face region than the first sole insert.

12. The golf putter of claim 2 wherein the material that forms one of the sole inserts is selected from the group consisting of plastic and epoxy.

13. The golf putter of claim 2 further comprising a substantially circular upper region insert, and wherein the putter body includes an upper region that is substantially opposite the sole region, the upper region including an upper region cavity that receives the upper region insert, the upper region insert having a specific gravity that is lower than the specific gravity of the second sole insert.

14. The golf putter of claim 13 wherein the upper region insert has a diameter that is greater than approximately 1.00 inches and less than 1.60 inches.

15. The golf putter of claim 2 wherein the first sole insert has a different shape than the second sole insert.

16. The golf putter of claim 2 wherein the second sole insert is substantially wedge-shaped.

17. A golf putter for putting a ball along a surface, the golf putter comprising:

a putter body having a substantially centrally positioned transition plane that demarcates the putter body into a heel region and a toe region, the putter body being formed substantially from a material having a first specific gravity the putter body including (i) a sole region that defines a first sole cavity, (ii) a face region that strikes the ball during putting, and (iii) a back region;

a heel weight that is secured to the heel region, the heel weight being formed substantially from a material having a second specific gravity that is greater than the first specific gravity, the heel weight having a center of gravity;

a toe weight that is secured to the toe region, the toe weight being spaced apart from the heel weight, the toe weight being formed substantially from a material having a third specific gravity that is greater than the first specific gravity, the toe weight having a center of gravity; and a first sole insert that is inserted into the first sole cavity, the first sole insert being formed substantially from a material having a fourth specific gravity that is greater than the first specific gravity, the first sole insert having a center of gravity;

wherein the center of gravity of the heel weight, the toe weight and the first sole insert form vertices of a triangle that defines a plane that is angled in a downwardly direction moving from the face region toward the back region when the sole insert is in contact with the surface.

18. The golf putter of claim 17 wherein the first sole insert is positioned partly in the heel region and partly in the toe region.

19. The golf putter of claim 17 wherein the heel weight has a weight that is substantially similar to a weight of the toe weight.

20. The golf putter of claim 17 wherein the second specific gravity and the third specific gravity are each substantially similar to the fourth specific gravity.

21. The golf putter of claim 17 wherein the sole region has a sole surface, and wherein the triangle forms an angle with the sole surface that is greater than approximately 5 degrees and less than approximately 45 degrees.

22. The golf putter of claim 17 wherein the fourth specific gravity is at least 50% greater than the first specific gravity.

23. The golf putter of claim 17 further comprising a second sole insert, and wherein the sole region defines a second sole cavity that receives the second sole insert.

24. The golf putter of claim 23 wherein the first sole insert has a different volume than the second sole insert.

25. The golf putter of claim 23 wherein at least one of the sole inserts is positioned partly in the heel region and partly in the toe region.

26. The golf putter of claim 23 wherein the second sole insert is formed substantially from a material having a sixth specific gravity that is lower than the fourth specific gravity.

27. The golf putter of claim 26 wherein the fourth specific gravity is at least 300% greater than the fifth specific gravity.

28. The golf putter of claim 17 wherein the triangle has two sides having the approximately the same length as one another.

29. The golf putter of claim 17 wherein the putter body includes an upper cavity, the golf putter further comprising an upper region insert that is positioned in the upper cavity, the upper region insert substantially facing an opposite direction from the first sole insert, the upper region insert having a substantially circular shape.

30. The golf putter of claim 29 wherein the upper region insert has a diameter of greater than approximately 1.00 inches and less than 1.60 inches.

31. The golf putter of claim 29 wherein the upper region insert includes an alignment guide to align the putter body with the ball prior to striking the ball.

32. The golf putter of claim 31 wherein the alignment guide is positioned substantially perpendicularly to an axis that extends between the heel weight and the toe weight.

33. The golf putter of claim 31 wherein the putter body includes a V-shaped alignment channel that defines a plane that is positioned substantially orthogonally to the alignment guide.

34. The golf putter of claim 29 wherein the upper region insert is substantially white in color.

35. A golf putter for putting a ball along a surface, the golf putter comprising:

a putter body having a centrally positioned transition plane that demarcates the putter body into a heel region and a toe region, the putter body including a sole region that defines a first sole cavity and a second sole cavity, each sole cavity being positioned partly in the heel region and partly in the toe region, the putter body being formed substantially from a material having a first specific gravity;

a first sole insert that is inserted into the first sole cavity, the first sole insert being formed substantially from a material having a second specific gravity that is different from the first specific gravity;

a second sole insert that is inserted into the second sole cavity, the second sole insert being formed substantially from a material having a third specific gravity that is different than the first and second specific gravities;

a heel weight that is secured to the heel region, the heel weight being formed substantially from a material having a fourth specific gravity that is greater than the first specific gravity; and a toe weight that is secured to the toe region, the toe weight being spaced apart from the heel weight, the toe weight being formed substantially from a material having a fifth specific gravity that is greater than the first specific gravity.

36. The golf putter of claim 35 wherein the heel weight, the toe weight and the first sole insert each includes a center of gravity, and wherein the center of gravity of the heel weight, the toe weight and the first sole insert form vertices of a triangle having two sides that are approximately the same length.

37. The golf putter of claim 35 wherein the putter body includes a face region that strikes the ball during putting and a back region, wherein the heel weight, the toe weight and the first sole insert each includes a center of gravity, and wherein the center of gravity of the heel weight, the toe weight and the first sole insert form vertices of a triangle that defines a plane sloping in a downwardly direction moving from the face region toward the back region when one of the sole inserts is in contact with the surface.

38. The golf putter of claim 35 wherein the putter body includes a face region that is adapted to strike the ball during putting, and wherein at least a portion of the first sole insert is positioned further from the face region than the second sole insert.

39. A golf putter for putting a bail along a surface, the golf putter comprising:

a putter body having a centrally positioned transition plane that demarcates the putter body into a heel region and a toe region, the putter body including (i) a sole region that defines a first sole cavity and a second sole cavity, each sole cavity being positioned partly in the heel region and partly in the toe region, and (ii) a face region that is adapted to strike the ball during putting, the putter body being formed substantially from a material having a first specific gravity;

a first sole insert that is inserted into the first sole cavity, the first sole insert being formed substantially from a material having a second specific gravity that is different from the first specific gravity; and a second sole insert that is inserted into the second sole cavity, the second sole insert being formed substantially from a material having a third specific gravity that is different than the first and second specific gravities;

wherein at least a portion of the first sole insert is positioned further from the face region than the second sole insert.

40. The golf putter of claim 39 wherein the second specific gravity is greater than the first specific gravity.

41. The golf putter of claim 39 wherein the third specific gravity is less than the first and second specific gravities.

42. The golf putter of claim 41 wherein the second specific gravity is greater than the first specific gravity.

43. The golf putter of claim 39 wherein the first sole insert has a volume that is less than approximately 50% of a volume of the second sole insert.

44. The golf putter of claim 39 wherein each of the sole inserts is positioned substantially symmetrically relative to the transition plane.

45. The golf putter of claim 39 wherein the volume of the first sole insert is approximately the same as the volume of the first sole cavity.

46. A golf putter for putting a ball along a surface, the golf putter comprising:

a putter body having a centrally positioned transition plane that demarcates the putter body into a heel region and a toe region, the putter body including (i) a sole region that defines a first sole cavity and a second sole cavity, each sole cavity being positioned partly in the heel region and partly in the toe region, and (ii) a face region that is adapted to strike the ball during putting, the putter body being formed substantially from a material having a first specific gravity;

a first sole insert that is inserted into the first sole cavity, the first sole insert being formed substantially from a material having a second specific gravity that is different from the first specific gravity; and a second sole insert that is inserted into the second sole cavity, the second sole insert being formed substantially from a material having a third specific gravity that is different than the first and second specific gravities;

wherein the entire first sole insert is positioned further from the face region than the second sole insert.

47. A golf putter for putting a ball along a surface, the golf putter comprising:

a putter body having a centrally positioned transition plane that demarcates the putter body into a heel region and a toe region, the putter body including (i) a sole region that defines a first sole cavity and a second sole cavity, each sole cavity being positioned partly in the heel region and partly in the toe region and (ii) an upper region that is substantially opposite the sole region, the upper region including an upper region cavity, the putter body being formed substantially from a material having a first specific gravity;

a first sole insert that is inserted into the first sole cavity, the first sole insert being formed substantially from a material having a second specific gravity that is different from the first specific gravity;

a second sole insert that is inserted into the second sole cavity, the second sole insert being formed substantially from a material having a third specific gravity that is different than the first and second specific gravities; and a substantially circular upper region insert that is at least partially positioned within the upper region cavity, the upper region insert having a fourth specific gravity that is less than the first specific gravity.

48. The golf putter of claim 47 wherein the upper region insert is substantially white in color and has a diameter that is greater than approximately 1.00 inches and less than 1.60 inches.

49. A golf putter for putting a ball along a surface, the golf putter comprising:

a putter body having a centrally positioned transition plane that demarcates the putter body into a heel region and a toe region, the putter body including (i) a sole region that defines a first sole cavity having a first volume and a second sole cavity having a second volume that is greater than the first volume, and (ii) an upper region that is substantially opposite the sole region, the putter body being substantially formed from a material having a first specific gravity;

a first sole insert that is positioned with the first sole cavity, the first sole insert having a volume that is approximately the same as the first volume;

a second sole insert that is positioned within the second sole cavity the second sole insert having a volume that is approximately the same as the second volume; and a substantially circular upper region insert that is secured to the upper region, the upper region insert having a second specific gravity that is lower than the first specific gravity, the upper region insert having a diameter that is greater than approximately 1.00 inches and less than 1.60 inches.

50. The golf putter of claim 49 wherein the first sole insert is substantially formed from a material having a first specific gravity, and the second sole insert is substantially formed from a material having a second specific gravity that is different than the first specific gravity.

51. The golf putter of claim 50 wherein the first specific gravity is at least approximately 300% greater than the second specific gravity.

52. The golf putter of claim 49 wherein the first volume is less than approximately 50% of the second volume.

53. The golf putter of claim 49 wherein the putter body includes a face region that is adapted to strike the ball during putting, and wherein the entire first sole insert is positioned further from the face region than the second sole insert.

54. The golf putter of claim 49 wherein each of the sole cavities is positioned partly in the heel region and partly in the toe region.

55. A golf putter for putting a ball along a surface, the golf putter comprising:

a putter body having a centrally positioned transition plane that demarcates the putter body into a heel region and a toe region, the putter body including (i) a sole region that defines a first sole cavity having a first volume and a second sole cavity having a second volume that is greater than the first volume, (ii) a face region that strikes the ball during putting, and (iii) a back region;

a first sole insert that is positioned with the first sole cavity, the first sole insert having a volume that is approximately the same as the first volume;

a second sole insert that is positioned within the second sole cavity, the second sole insert having a volume that is approximately the same as the second volume;

a heel weight that is secured to the heel region, the heel weight being formed substantially from a material having a specific gravity that is greater than a specific gravity of the material that substantially forms the putter body; and a toe weight that is secured to the toe region, the toe weight being spaced apart from the heel weight, the toe weight being formed substantially from a material having a specific gravity that is greater than the specific gravity of the material that substantially forms the putter body;

wherein the heel weight the toe weight and the first sole insert each has a center of gravity, and wherein the center of gravity of the heel weight, the toe weight and the first sole insert form vertices of a triangle that defines a plane sloping in a downwardly direction moving from the face region toward the back region when one of the sole inserts is in contact with the surface.

56. A method of manufacturing a golf putter, the method comprising the steps of:

providing a putter body having a centrally positioned transition plane that demarcates the putter body into a heel region and a toe region;

forming a first sole cavity in the putter body of the putter so that the first sole cavity has a first volume;

forming a second sole cavity in the putter body of the putter so that the second cavity has a second volume that is greater than the first volume;

positioning one of the sole cavities partly in the heel region and partly in the toe region of the putter body;

positioning a first sole insert in the first sole cavity; and positioning a second sole insert in the second sole cavity.

57. The method of claim 56 further comprising the steps of (i) forming a heel weight from a material having a specific gravity that is greater than the first specific gravity, (ii) forming a toe weight from a material having a specific gravity that is greater than the first specific gravity, and (iii) positioning the heel weight in the heel region and positioning the toe weight in the toe region so that a center of gravity of the heel weight a center of gravity of the toe weight, and a center of gravity of the second sole insert define a triangle having two sides that are approximately of equal length.

58. The method of claim 57 wherein the steps of positioning the heel weight and positioning the toe weight include defining a plane with the center of gravity of the heel weight, the center of gravity of the toe weight, and the center of gravity of the second sore insert that slopes downward as the plane moves from the center of gravity of the heel region and the center of gravity of the toe region toward the center of gravity of the second sole region.

59. The method of claim 56 wherein the step of positioning a first sole insert includes providing a first sole insert having a first specific gravity, and the step of positioning a second sole insert includes providing a second sole insert having a second specific gravity that is different than the first specific gravity.

60. The method of claim 56 wherein the step of positioning one of the sole cavities includes positioning both of the sole cavities partly in the heel region and partly in the toe region of the putter body.

* * * * *

UNITED STATES PATENT AND TRADEMARK OFFICE

CERTIFICATE OF CORRECTION

PATENT NO. : 7,083,526 B2
APPLICATION NO. : 10/767323
DATED : August 1, 2006
INVENTOR(S) : Timothy Durnin It is certified that error appears in the above-identified patent and that said Letters Patent is hereby corrected as shown below:

In Col. 22, claim 17, line 7, please add -- , -- after the word "gravity".

On the cover page, col. 2, under the heading "References Cited", please add the following two references under "U.S. PATENT DOCUMENTS":

-- 6,440,006 B1 * 8/2002 Johnson --

-- 6,902,496 B1 * 6/2005 Solheim et al. --

Signed and Sealed this

Fourteenth Day of November, 2006

JON W. DUDAS
*Director of the United States Patent and Trademark Office*